US006948711B2

(12) United States Patent
Kanai

(10) Patent No.: US 6,948,711 B2
(45) Date of Patent: Sep. 27, 2005

(54) SHEET EJECTION APPARATUS, SHEET PROCESSING APPARATUS AND SHEET EJECTION UNIT

(75) Inventor: Kenji Kanai, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 91 days.

(21) Appl. No.: 10/322,580

(22) Filed: Dec. 19, 2002

(65) Prior Publication Data

US 2003/0116911 A1 Jun. 26, 2003

(30) Foreign Application Priority Data

Dec. 20, 2001 (JP) ..... P2001-388592
Sep. 20, 2002 (JP) ..... P2002-276424

(51) Int. Cl.[7] ..... B65H 43/04
(52) U.S. Cl. ..... 271/279
(58) Field of Search ..... 271/278, 279, 271/207, 152, 176, 199; 270/58.14; 399/405; 162/269; 400/691, 692

(56) References Cited

U.S. PATENT DOCUMENTS 6,112,047 A * 8/2000 Kato et al. ..... 399/381
6,304,742 B1 * 10/2001 Nunes et al. ..... 399/361

FOREIGN PATENT DOCUMENTS

| | | | | |
|---|---|---|---|---|
| JP | 6-127789 | * | 5/1994 | ..... B65H/31/20 |
| JP | 9-68910 | * | 3/1997 | ..... C03G/21/16 |
| JP | 2000-103564 | * | 4/2000 | ..... B65H/33/08 |
| JP | 2000-302311 | | 10/2000 | |

* cited by examiner

*Primary Examiner*—Donald P. Walsh
*Assistant Examiner*—Kenneth W. Bower
(74) *Attorney, Agent, or Firm*—Morgan, Lewis & Bockius LLP

(57) ABSTRACT

A sheet ejection apparatus which is built in as a part of a processing apparatus main unit for ejecting a sheet processed by a processing section in the processing apparatus main unit to a sheet stack section placed on the top of the processing apparatus main unit. The processing apparatus main unit is formed with a unit reception section and one of sheet ejection units different in specifications can be attached to the unit reception section. The invention is also applied to a sheet processing apparatus using the sheet ejection apparatus.

27 Claims, 27 Drawing Sheets

SHEET EJECTION APPARATUS, SHEET PROCESSING APPARATUS AND SHEET EJECTION UNIT

The present disclosure relates to the subject matter contained in Japanese Patent Application No. 2001-388592 filed Dec. 20, 2001 and Japanese Patent Application No. 2002-276424 filed Sep. 20, 2002, which are incorporated herein by reference in their entirety.

BACKGROUND OF THE INVENTION

1. Field of the Invention

This invention relates to a sheet ejection apparatus built in a sheet processing apparatus including an image formation apparatus such as a copier or a printer as a part of a processing apparatus main unit and in particular to a sheet ejection apparatus intended for easily changing the number of ejected sheets that can be stored and a sheet processing apparatus using the sheet ejection apparatus.

2. Description of the Related Art

As this kind of sheet processing apparatus in a related art, taking an image formation apparatus as an example, an image formation engine containing a photo conductor drum, etc., for example, is installed in an image formation apparatus main unit (processing apparatus main unit), a sheet supply unit and an ejection tray are placed in the processing apparatus main unit, the image formation engine is formed with a sheet transport passage from the sheet supply unit to the ejection tray and forms an image by electrophotography, for example, and the image formed by the image formation engine is transferred to a sheet of paper, etc., supplied from the sheet supply unit, and then the image is fixed on the sheet by a fuser and the sheet on which the image has been fixed is ejected to the ejection tray.

In this kind of image formation apparatus, a sheet ejection apparatus is built in the exit of the processing apparatus main unit.

As a sheet ejection apparatus in a related art, a unit comprising paired ejection rolls built integrally in the exit of a fuser unit, for example, is used.

To increase the number of sheets that can be stored in an ejection tray, a sheet ejection apparatus comprising an upper ejection tray and a lower ejection tray for distributing ejected sheets to the upper and lower ejection trays is already proposed such as in JP-A-2000-302311 (see Mode for Carrying out the Invention, FIG. 1).

However, in this kind of sheet ejection apparatus, the sheet ejection position to each ejection tray is uniquely fixed and thus the number of ejected sheets that can be stored in each ejection tray is inevitably limited, and it is difficult for the user to change the number of ejected sheets that can be stored.

For example, in the art disclosed in JP-A-2000-302311, as two ejection trays are provided, the number of sheets that can be stored is increased as compared with the type wherein one ejection tray is provided, but the number of sheets that can be stored in each ejection tray cannot be changed. Thus, if the user wants to drastically increase the number of sheets that can be stored in each ejection tray, a large-capacity sheet storage unit must be retrofitted or the image formation apparatus must be changed to an image formation apparatus of a large-capacity model.

SUMMARY OF THE INVENTION

It is therefore an object of the invention to provide a sheet ejection apparatus for making it possible to easily change the number of ejected sheets that can be stored.

It is another object of the invention to provide a sheet processing apparatus for making it possible to easily change the number of ejected sheets that can be stored while miniaturization of the apparatus itself is intended by using the sheet ejection apparatus.

According to the present invention, there is provided a sheet ejection apparatus comprising: an unit reception section, wherein the sheet ejection apparatus being built in as a part of a processing apparatus main unit for ejecting a sheet processed by a processing section in the processing apparatus main unit to a sheet stack section placed on the top of the processing apparatus main unit, and the unit reception section is disposed on the processing apparatus main unit side and one of sheet ejection units different in specifications is attachable to the unit reception section.

Also, there is provided a sheet ejection apparatus comprising: an unit reception section, wherein the sheet ejection apparatus being built in as a part of a processing apparatus main unit for ejecting a sheet processed by a processing section in the processing apparatus main unit to a sheet stack section placed on the top of the processing apparatus main unit, the unit reception section is disposed on the processing apparatus main unit side and a sheet ejection unit is attached detachably to the unit reception section.

Further, there is provided a sheet ejection unit used in a sheet processing apparatus built in as a part of a processing apparatus main unit for ejecting a sheet processed by a processing section in the processing apparatus main unit to a sheet stack section placed on the top of the processing apparatus main unit, the sheet ejection unit comprising: a facing section facing to an unit reception section disposed on the processing apparatus main unit side, wherein the sheet ejection unit is attached detachably to the unit reception section.

DESCRIPTION OF THE INVENTION

Figure 1:
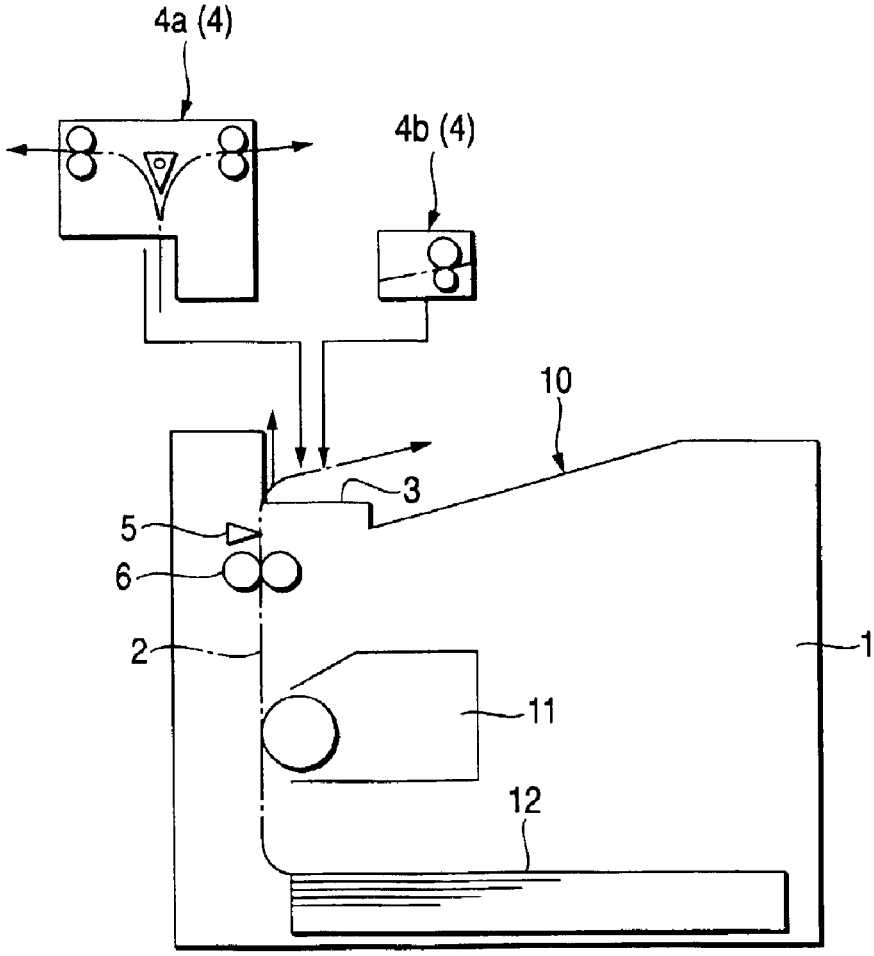
FIG. 1 is a schematic representation to show an outline of a sheet ejection apparatus according to the invention and an image formation apparatus using the sheet ejection apparatus.

According to the invention, there is provided a sheet ejection apparatus being built in as a part of a processing apparatus main unit 1 for ejecting a sheet processed by a processing section in the processing apparatus main unit 1 to a sheet stack section 10 placed on the top of the processing apparatus main unit 1, characterized in that the processing apparatus main unit 1 is formed with a unit reception section 3 and one of sheet ejection units 4 (4*a*, 4*b*) different in types can be attached to the unit reception section 3, as shown in FIG. 1.

In such technical means, the sheet ejection apparatus widely includes forms for ejecting a processed sheet, and it is assumed that the sheet ejection apparatus is built in the processing apparatus main unit 1.

Thus, the sheet ejection apparatus according to the invention requires that it be "built in as a part of the processing apparatus main unit 1," and the sheet ejection apparatus is one component of the processing apparatus main unit 1 and therefore an optional added sheet ejection apparatus, etc., is excluded.

The "sheet stack section 10 placed on the top of the processing apparatus main unit 1" includes not only a form implemented as a top cover of the processing apparatus main unit 1, but also a form wherein an additional tray member is disposed on the top of the processing apparatus main unit 1.

Further, the "unit reception section 3" widely includes a reception section for making it possible to attach any of sheet ejection units 4 (for example, 4*a*, 4*b*) different in specifications.

The unit reception section 3 may have a common space wherein any of sheet ejection units 4 different in specifications can be disposed, and may usually comprise engaged parts corresponding to engagement parts of the sheet ejection unit 4.

As the engaged parts, a positioned part, an attached part, etc., can be named; all or some of the engaged parts may be made common to the sheet ejection units 4 different in specifications or all may be separate.

Further, the expression "one of sheet ejection units 4 different in specifications can be attached" includes not only a form wherein the sheet ejection unit 4 is attached and detached on the market, but also a form wherein the sheet ejection unit 4 is attached at the shipment time and is not attached or detached on the market, for example.

Because of "sheet ejection units 4 different in specifications," the sheet ejection apparatus intended for only a sheet ejection unit of the same specifications is excluded.

The sheet ejection unit 4 may be a unit for ejecting a sheet and considering replaceability of the sheet ejection unit 4 on the market, preferably the sheet ejection unit 4 can be attached to and detached from the unit reception section 3.

In this case, the sheet ejection unit 4 can be easily replaced and thus enables easy maintenance and in addition, if sheet ejection units 4 (for example, 4*a*, 4*b*) different in specifications of sheet ejection port positions are provided, change in the number of ejected sheets that can be stored can be easily covered.

Further, the sheet ejection unit 4 comprises an ejection member 9 (see FIGS. 2A and 2B) disposed closest to the upper face of the sheet stack section 10 placed on the top of the processing apparatus main unit 1 from the viewpoint of the positional relationship with the sheet stack section 10.

As for an optional added sheet ejection apparatus, its ejection member is not placed closest to the upper face of the sheet stack section 10, and the ejection member 9 of the sheet ejection apparatus built in as a part of the processing apparatus main unit 1 is always placed close to the upper face of the sheet stack section 10.

As a form wherein the ejected sheet capacity to the sheet stack section 10 is increased or decreased, the sheet ejection units 4 different in specifications may differ in height dimension from the upper face of the sheet stack section 10 to the ejection member 9 in the attachment state to the unit reception section 3.

As representative forms of the sheet ejection units 4 (for example, 4*a*, 4*b*), the sheet ejection unit comprising a connection member electrically connected to the processing apparatus main unit 1 with the unit reception section, that comprising a positioning section for mechanically positioning with the unit reception section, and that comprising an attachment section that can be attached with a fixture with the unit reception section can be named.

Here, to make it possible to attach and detach the sheet ejection unit 4, the fixture to the attachment section may be made able to be attached and detached.

For example, if the connection member and the positioning section are provided, the user, etc., can easily attach and detach the sheet ejection unit 4 at an installation location, etc., of the sheet processing apparatus.

For example, if the positioning section and the attachment section are provided, a situation can be effectively circumvented in which the sheet ejection unit 4 and the processing apparatus main unit 1 are detached from each other while the sheet ejection apparatus is distributed after factory shipment.

In a form comprising the sheet ejection unit 4 that can be attached and detached, from the viewpoint of attaching and detaching the sheet ejection unit 4 safely, the sheet ejection unit 4 may comprise an ejection member 9 disposed closest to the upper face of the sheet stack section 10 placed on the top of the processing apparatus main unit 1 and the sheet ejection apparatus may further comprise a transmission mechanism (not shown) for transmitting a driving force from a drive source (not shown) placed in the processing apparatus main unit 1 to the ejection member 9, wherein the transmission mechanism may be stopped in a state in which the sheet ejection unit 4 is detached from the processing apparatus main unit 1.

According to the form, the load upon the worker concerning for any other than the direct attachment/detachment work is lightened, and the worker can easily attach and detach the sheet ejection unit 4.

Here, the transmission mechanism can be a form wherein it is divided into a main unit transmission mechanism and a unit transmission mechanism that can be connected and disconnected, a form of only a main unit transmission mechanism, or a form of only a unit transmission mechanism.

If the sheet ejection unit 4 is detached, the unit transmission mechanism usually is stopped naturally and thus stopping of the transmission mechanism introduces a problem mainly with respect to the main unit transmission mechanism.

The transmission mechanism may be stopped by stopping the drive source or may be stopped through a clutch, etc., without stopping the drive source.

In the form, as a representative form for stopping the transmission mechanism, the sheet ejection apparatus may further comprise determination means (not shown) for determining whether or not the sheet ejection unit 4 is detached from the processing apparatus main unit 1, and the transmission mechanism may be stopped in response to the determination result of the determination means.

Here, as a representative form including the determination means, the sheet ejection apparatus may further comprise a cover member that can be opened and closed, being placed on the processing apparatus main unit, for allowing the sheet ejection unit to be attached or detached when the cover is open, a blocking member for blocking the cover member closing in a state in which the sheet ejection unit is detached, and an interlocking device for disabling operation of the processing apparatus main unit in a state in which the cover member is open, wherein the interlocking device is used as the determination means.

A representative form of the cover member is a form wherein usually the sheet ejection unit is attached and detached through an opening, but the invention is not limited to it. For example, a form wherein when the cover member is closed, it functions as a stopper member of the sheet ejection unit 4 is also included.

As a representative selection criterion of the sheet ejection units 4 different in specifications, the sheet ejection capacity may be variably set in response to the sheet transport speed, the sheet supply amount, or the sheet processing amount (for example, the sheet processing amount of processing section of image formation section, etc.,) of the processing apparatus main unit 1.

Taking the sheet transport speed of the processing apparatus main unit 1 as an example, if the sheet transport speed is high, for example, the sheet ejection unit 4 having a high height dimension from the upper face of the sheet stack section 10 to the ejection member 9 with the sheet ejection unit 4 attached to the processing apparatus main unit 1 may be attached; on the other hand, if the sheet transport speed is low, the sheet ejection unit 4 having a low height dimension may be attached.

Further, to control the sheet ejection apparatus, usually a sensor 5 used for sheet ejection control is disposed in a sheet transport passage 2 in the processing apparatus main unit 1; preferably, the sensor 5 used for sheet ejection control is disposed before the sheet ejection unit 4 in the sheet transport passage 2 in the processing apparatus main unit 1.

According to the form, if the sheet ejection unit 4 is replaced, the position of the sensor 5 does not change and thus roughly similar control can be realized.

For example, the on/off operation time for the ejection member (ejection roll, etc.,) of the sheet ejection unit 4 needs only to be shifted as the distance between the sensor 5 and the ejection member changes with position change of the ejection member.

Although a drive source for driving an ejection member 9 for ejecting a sheet (see FIGS. 2A and 2B) may be disposed in the processing apparatus main unit 1, preferably the drive source is disposed in the sheet ejection unit 4.

According to the form, an optimum drive source can be selected in response to any of the sheet ejection units 4 different in specifications. In other words, over-specification for a sheet ejection unit with a low load as the drive source is selected matching the sheet ejection unit with the highest load can be prevented.

Further, the sheet ejection unit 4 maybe formed separately from an exterior cover of the sheet ejection apparatus or may be formed integrally with the exterior cover of the sheet ejection apparatus.

The former case is preferred in that the ejection part, one of the most conspicuous parts, can be changed in design appropriately in response to various units; the latter case is preferred in that attachment and detachment are easy and replacement work is facilitated.

Further, preferably the sheet ejection unit 4 is attached from an upper side toward a down side of the processing apparatus main unit 1.

In this case, replacement work is furthermore facilitated.

Figure 2A:
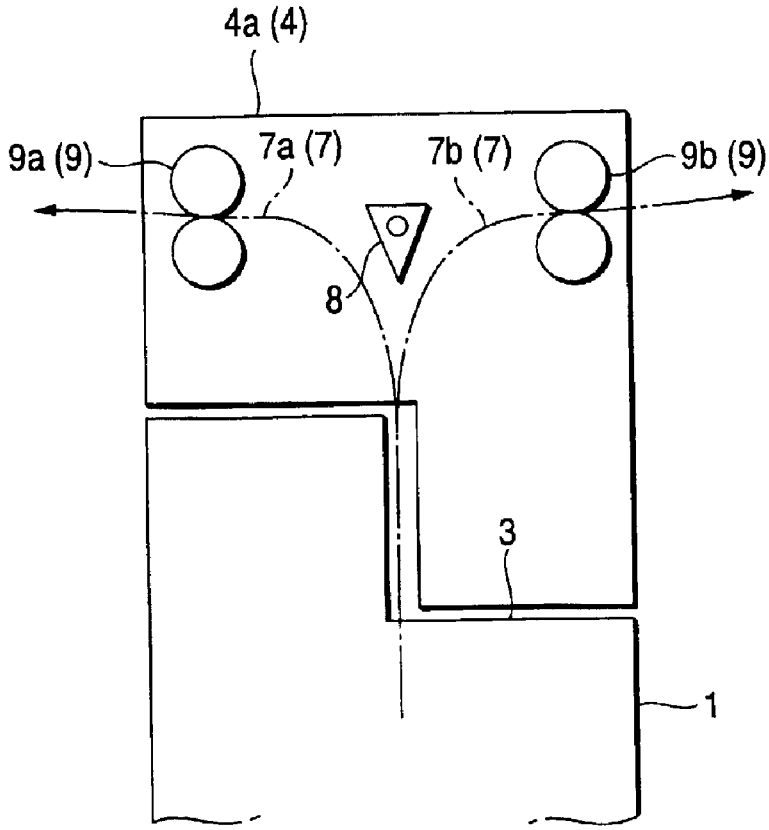
FIG. 2A is a schematic representation to show a state in which a sheet ejection unit 4*a* is attached to the sheet ejection apparatus according to the invention and FIG. 2B is a schematic representation to show a state in which a sheet ejection unit 4*b* is attached to the sheet ejection apparatus.
Figure 2B:
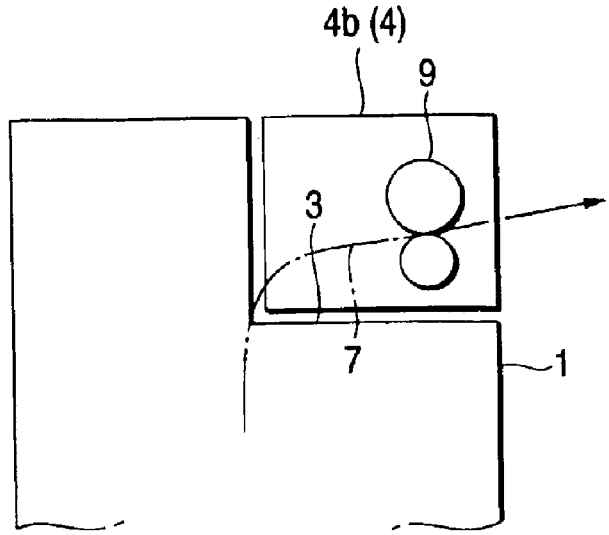

The sheet ejection unit 4 may comprise components for making it possible to at least eject sheets, for example, as shown in FIGS. 2A and 2B; the number and the layout of sheet ejection passages 7, the number and the layout of switch members 8 for switching the sheet ejection passages 7, the number and the layout of ejection members 9, and the like may be selected appropriately.

For example, in a form wherein the processing apparatus main unit 1 comprises a fuser 6 for fixing an unfixed image on a sheet and the sheet ejection apparatus is placed downstream from the fuser 6, preferably the sheet ejection unit 4 (for example, 4*a*) is provided with an ejection passage 7 (for example, ejection passage 7*a* in FIG. 2A) extended in a direction in which a sheet curl occurring at least when the sheet passes through the fuser 6 can be corrected.

Further, to enable face-up ejection and face-down ejection, for example, as shown in FIG. 2A, the sheet ejection unit 4 may comprise a face-down ejection passage 7 (for example, 7*b*) for ejecting a sheet with an image face down and a face-up ejection passage 7 (for example, 7*a*) for ejecting a sheet with an image face up, the face-up and face-down ejection passages 7 being switchable.

Further, if a plurality of sheet ejection destinations exist, ejection passage 7, ejection member 9, and switch member 8 for switching the ejection passage 7 are required corresponding to each ejection destination. To enable three-direction branch ejection while intending miniaturization of the sheet ejection unit 4, the sheet ejection unit may have switchable ejection passages 7 branching at least in three directions.

As for the sheet ejection apparatus, for example, there are provided a sheet ejection unit 4 (for example, 4*a*) comprising two channels of ejection passages 7 (7*a* and 7*b*), two channels of ejection members 9 (9*a* and 9*b*), and a switch member 8 for switching the ejection passages 7 as shown in FIGS. 1 and 2A, and a sheet ejection unit 4 (for example, 4*b*) comprising one ejection member 9 disposed in an ejection passage 7 extended in one direction as shown in FIGS. 1 and 2B, and the sheet ejection unit 4*a* or 4*b* can be selectively attached to the unit reception section 3 of the processing apparatus main unit 1 in response to the user's demand.

According to another aspect of the invention, there is provided a sheet ejection apparatus being built in as a part of a processing apparatus main unit 1 for ejecting a sheet processed by a processing section in the processing apparatus main unit 1 to a sheet stack section 10 placed on the top of the processing apparatus main unit 1, wherein the processing apparatus main unit 1 is formed with a unit reception section 3 and a sheet ejection unit 4 is attached detachably to the unit reception section 3, as shown in FIG. 1.

In this form, making it possible to attach any of sheet ejection units 4 different in specifications does not become a requirement and thus a form wherein one type of sheet ejection unit 4 can be attached and detached (the sheet ejection unit is replaced with a new one in maintenance), for example, is also included.

The invention is not limited to the sheet ejection apparatus described above and is also applied to a sheet processing apparatus incorporating the sheet ejection apparatus.

To use an image formation apparatus as the sheet processing apparatus, it is necessary to incorporate an image formation engine 11 and a sheet supply unit 12 as a processing section.

DETAILED DESCRIPTION OF THE PREFERRED EMBODIMENTS

Referring now to the accompanying drawings, there are shown preferred embodiments of the invention.

Figure 3:
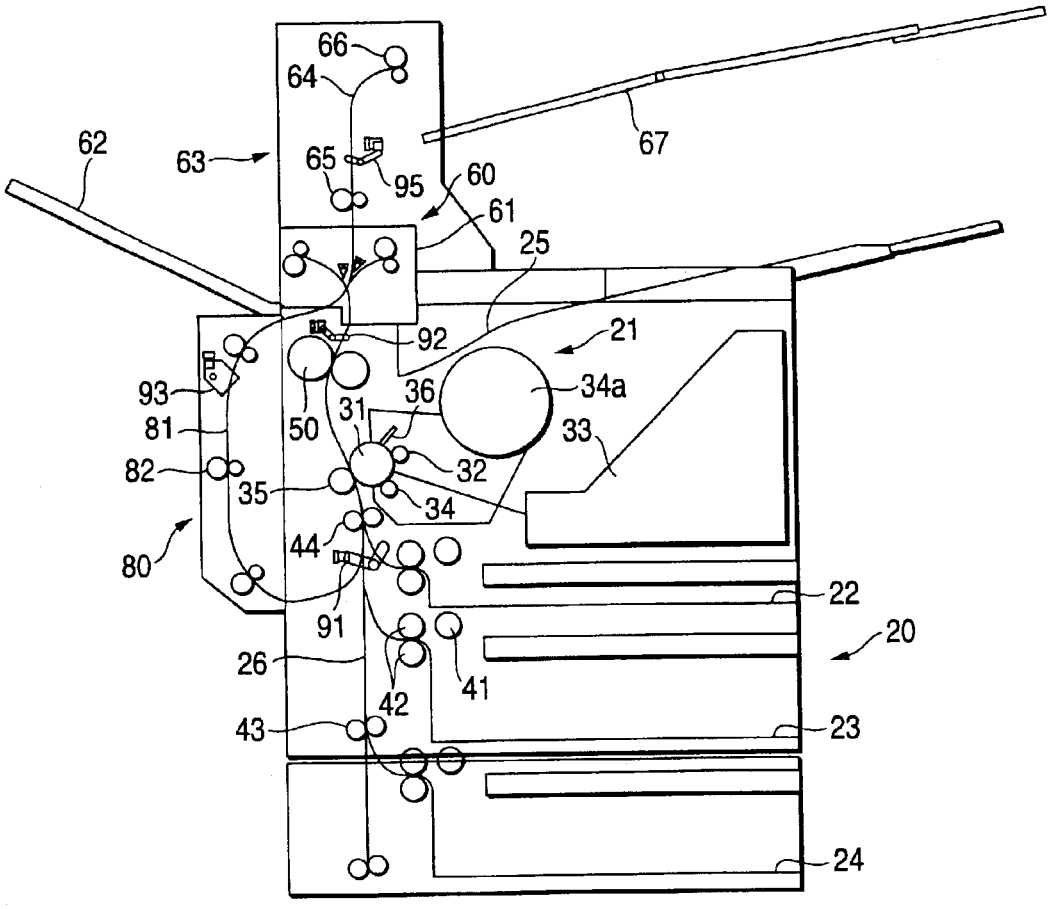
FIG. 3 is a schematic representation to show a first embodiment of a sheet processing apparatus incorporating the invention.

First Embodiment:

FIG. 3 is a schematic representation to show the general configuration of a first embodiment of a sheet processing apparatus (in the example, an image formation apparatus) incorporating the invention.

In the figure, the image formation apparatus comprises an image formation engine 21 installed in an apparatus main unit (corresponding to a processing apparatus main unit) 20, a predetermined number of (in the example, three) sheet supply units 22 to 24 (in the example, the bottom sheet supply unit 24 is installed externally) disposed below the image formation engine 21, an ejection tray 25 for storing ejected sheets, disposed on the top of the apparatus main unit 20, and a sheet transport passage 26 extended in a roughly vertical direction from the sheet supply units 22 to 24 to the ejection tray 25.

In the embodiment, an electrophotographic image formation engine is adopted as the image formation engine 21, for example. The image formation engine 21 comprises a photoconductor drum 31, a charger (for example, a charging roll) 32 for charging the photoconductor drum 31, an optical unit (for example, a laser scanner) 33 for writing a latent image onto the photoconductor drum 31 by application of a light beam, a developing unit 34 for visualizing the latent image on the photoconductor drum 31 in toner as a developer, a transfer unit (for example, a transfer roll) 35 for transferring the visual image (toner image) on the photoconductor drum 31, and a cleaning unit (for example, a blade cleaning unit) 36 for cleaning the remaining toner on the photoconductor drum 31.

In the embodiment, the photoconductor drum 31, the charger 32, the developing unit 34, and the cleaning unit 36 are formed in one piece as a process cartridge, which can be attached to and detached from the apparatus main unit 20. In the example, the developing unit 34 comprises a detachable toner cartridge 34*a*.

Further, in the embodiment, each of the sheet supply units 22 to 24 comprises a pickup roll 41 for taking out and transporting a sheet and a handling roll (for example, a combination of a feed roll and a retard roll) 42 for handling the taken-out sheets one at a time.

Further, an appropriate number of transport rolls 43 are placed in the sheet transport passage 26, a registration roll 44 for registering a sheet is disposed just before upstream from a transfer part of the photoconductor drum 31, and a fuser 50 is disposed downstream from the transfer part of the photoconductor drum 31.

In the embodiment, a sheet ejection apparatus 60 is disposed in the exit of the sheet transport passage 26; the sheet ejection apparatus 60 is built in as a part of the apparatus main unit 20 and comprises a sheet ejection unit 61 that can be attached to and detached from the apparatus main unit 20.

Figure 4:
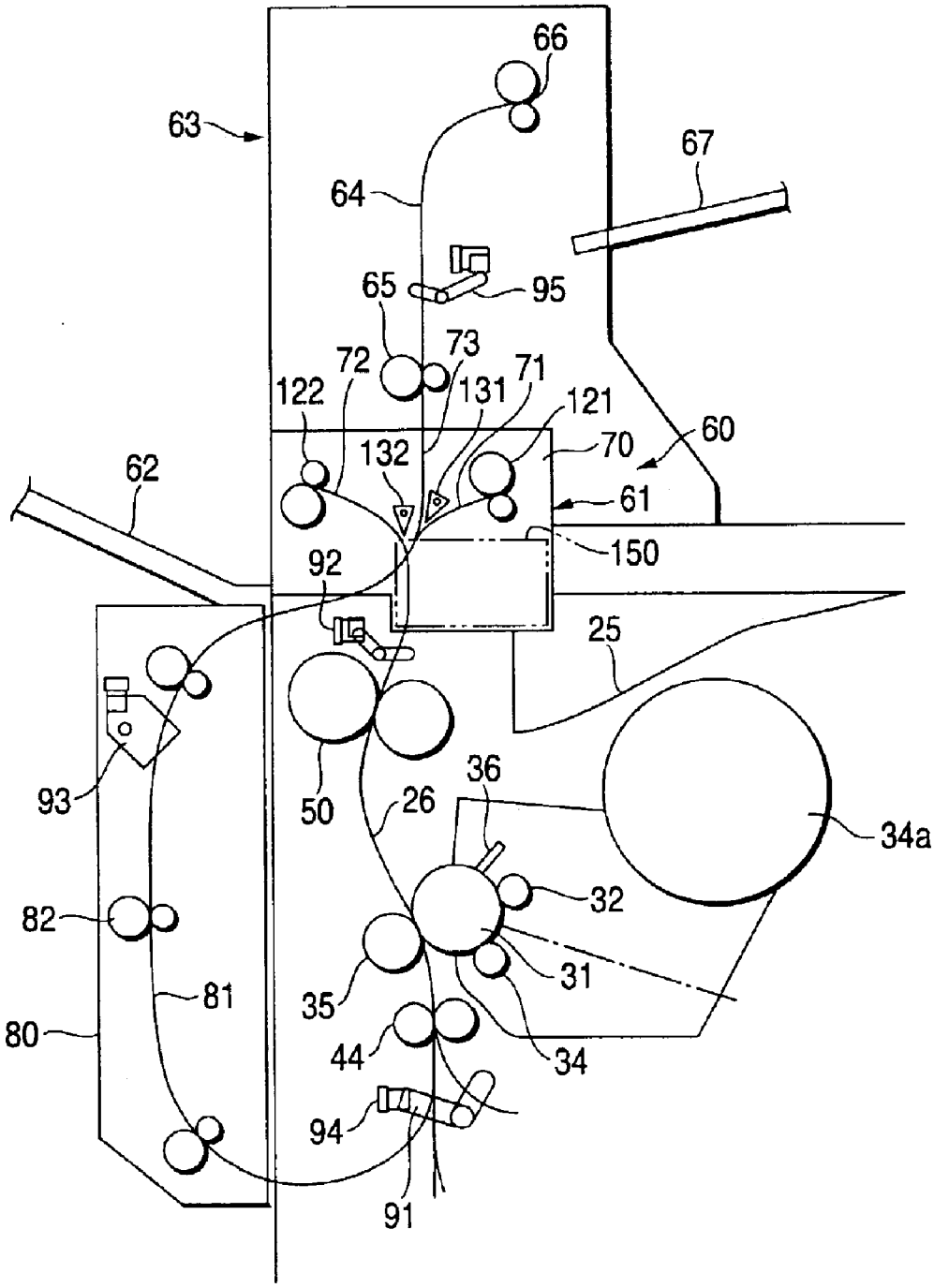
FIG. 4 is an enlarged drawing of the main part of the sheet processing apparatus in FIG. 3.

In the embodiment, as shown in FIGS. 3 and 4, the sheet ejection unit 61 has branch ejection passages 71 to 73 branching in three directions in a unit main body 70. The first branch ejection passage 71 is extended toward the ejection tray 25 on the top of the apparatus main unit 20, the second branch ejection passage 72 is extended toward the opposite side to the first branch ejection passage 71, and the third branch ejection passage 73 is extended roughly upward between the first and second branch ejection passages 71 and 72. A face-up tray 62 is disposed on the outside of the exit of the second branch ejection passage 72, and another optional ejection unit 63 is disposed in the upper part of the third branch ejection passage 73.

In the example, an offset catch tray (OCT) for offset-ejecting a sheet is used as the optional ejection unit 63, and the optional ejection unit 63 is provided with a sheet ejection passage 64, a transport roll 65, an ejection roll 66, and a tray member 67.

A double-sided record unit 80 is added to the apparatus main unit 20. When a double-side mode for recording an image on both sides of a sheet is selected, the double-sided record unit 80 takes a sheet with an image already recorded on one side into the inside from the sheet ejection apparatus 60, transports the sheet along an internal sheet return transport passage 81 by an appropriate number of transport rolls 82, and again supplying the sheet to the registration roll 44.

Further, in the embodiment, sensors 91 to 93 and 95 for detecting the sheet position are placed in the sheet transport passage 26, the sheet return transport passage 81, and the sheet ejection passage 64.

In the example, the sensor 91 is a registration sensor disposed in the merging part with the sheet return transport passage 81 just before upstream from the registration roll 44 in the sheet transport passage 26; the sensor 92 is an ejection sensor being disposed just before upstream from the sheet ejection unit 61 in the sheet transport passage 26 for being placed at the service of ejection control of a sheet; the sensor 93 is a position sensor being placed in the sheet return transport passage 81 for being placed at the service of double-sided record transport control of a sheet; and the sensor 95 is an ejection sensor being placed in the sheet ejection passage 64 for being placed at the service of ejection control of a sheet.

Figure 5:
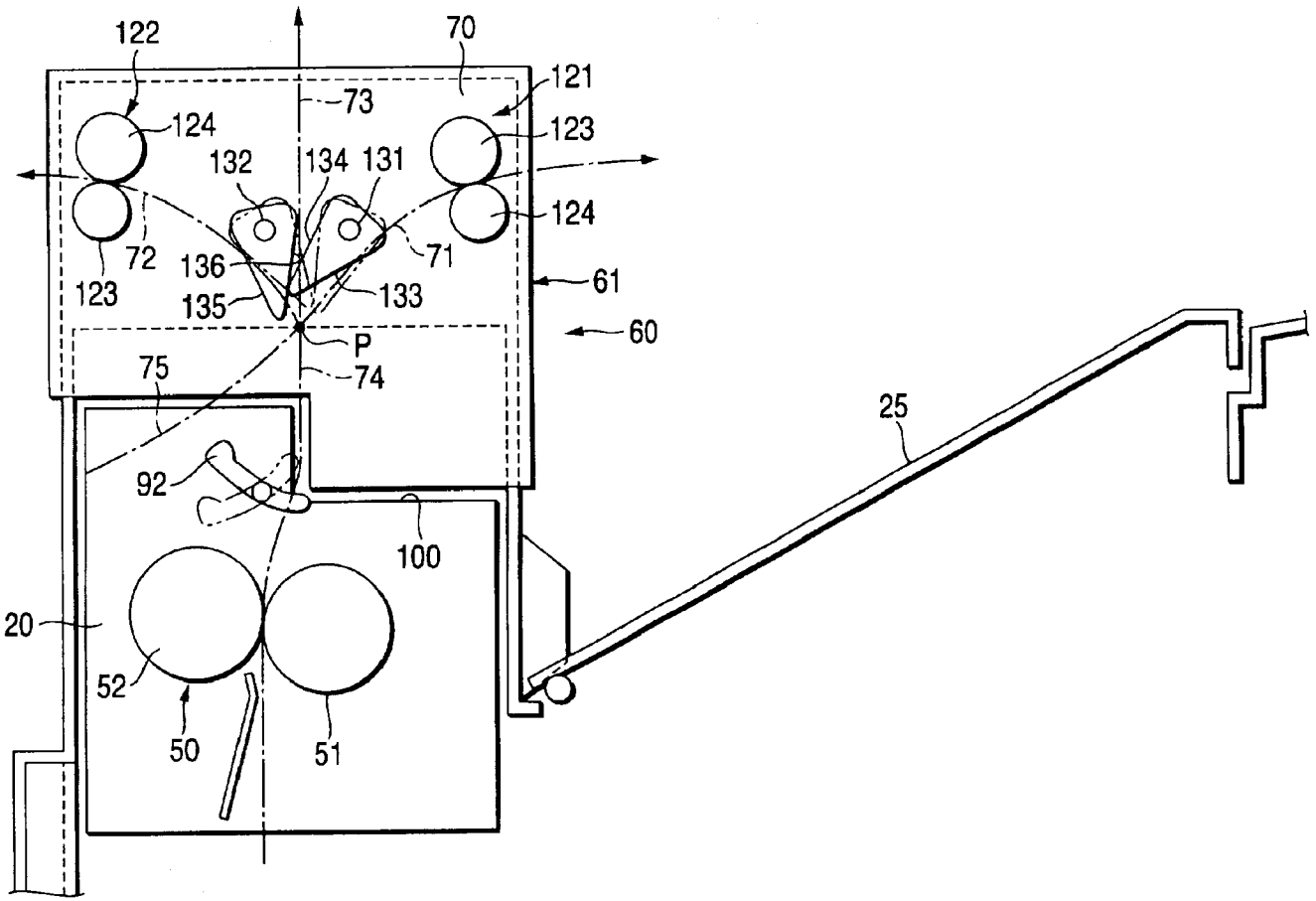
FIG. 5 is a schematic representation to show details of a sheet ejection apparatus used in the first embodiment of the invention.
Figure 6:
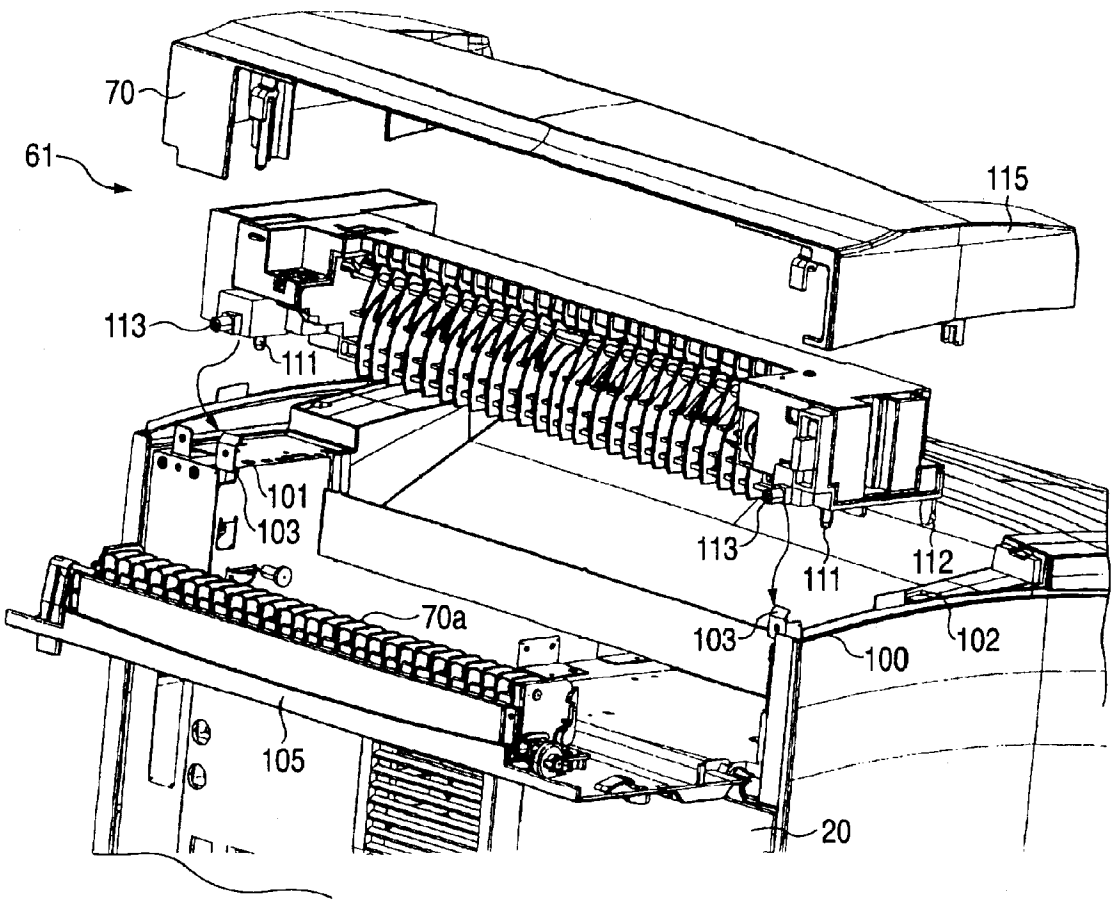
FIG. 6 is a perspective view of the main part of a sheet ejection unit used in the first embodiment of the invention.

Particularly, in the embodiment, the sheet ejection unit 61 has a unit reception section 100 on the top of the apparatus main unit 20 and is attached detachably to the unit reception section 100, as shown in FIGS. 4 to 6.

In this case, the attachment structure of the sheet ejection unit 61 is as follows: For example, as shown in FIG. 6, while the unit main body 70 is provided with positioning pins 111, retention protrusion 112, and screw reception recesses 113 as engagement parts, the unit reception section 100 is provided with positioning hole 101, retention hole 102, and screw pieces 103 as engaged parts that can be engaged with the engagement parts, and the engagement parts 111 to 113 are engaged in the engaged parts 101 to 103. Then, the sheet ejection unit 61 is screwed (not shown) and fixed in a state in which it is positioned and retained.

In the embodiment, a part 70*a* of the unit main body 70 is attached detachably to a door 105 of the apparatus main unit 20. In the figure, numeral 115 denotes an exterior cover of the sheet ejection unit 61.

In the embodiment, as shown in FIGS. 4 and 5, the sheet ejection unit 61 has a sheet carrying-in passage 74 extended downward to the fuser 50 upstream from a branch point P of the three branch ejection passages 71 to 73 branching in the unit main body 70 and is provided with a double-sided record transport passage 75 extended roughly linearly to the opposite side to the first branch ejection passage 71 with the branch point P between so as to communicate with the entrance of the sheet return transport passage 81 of the double-sided record unit 80.

Ejection roll pairs 121 and 122 are disposed in the vicinities of the exits of the first and second branch ejection passages 71 and 72 and further two switch gates 131 and 132 are disposed facing each other with the third branch ejection passage 73 between in the vicinity of the branch point P of the branch ejection passages 71 to 73.

In the embodiment, the ejection roll pairs 121 and 122 comprise each a drive ejection roll 123 and a driven ejection roll 124 brought into contact with each other for rotation.

The first switch gate 131 is made of a gate member shaped roughly like a triangle and comprises guide faces 133 and 134 provided by both sides of the gate member extended to the branch point P. The first switch gate 131 is switched swingably between a position indicated by the solid line (the position for blocking the third branch ejection passage 73 between the first and second switch gates 131 and 132 and guiding a sheet along the guide face 133 to the first branch ejection passage 71) and a position indicated by the phantom line (the position for blocking the first branch ejection passage 71 and guiding a sheet along the guide face 134 to the third branch ejection passage 73 between the first and second switch gates 131 and 132).

On the other hand, likewise the second switch gate 132 is made of a gate member shaped roughly like a triangle and comprises guide faces 135 and 136 provided by both sides of the gate member extended to the branch point P. The second switch gate 132 is switched swingably between a position indicated by the solid line (the position for blocking the second branch ejection passage 72 and guiding a sheet along the guide face 136 to the third branch ejection passage 73 between the first and second switch gates 131 and 132) and a position indicated by the phantom line (the position for blocking the third branch ejection passage 73 between the first and second switch gates 131 and 132 and guiding a sheet along the guide face 135 to the second branch ejection passage 72).

Figure 7:
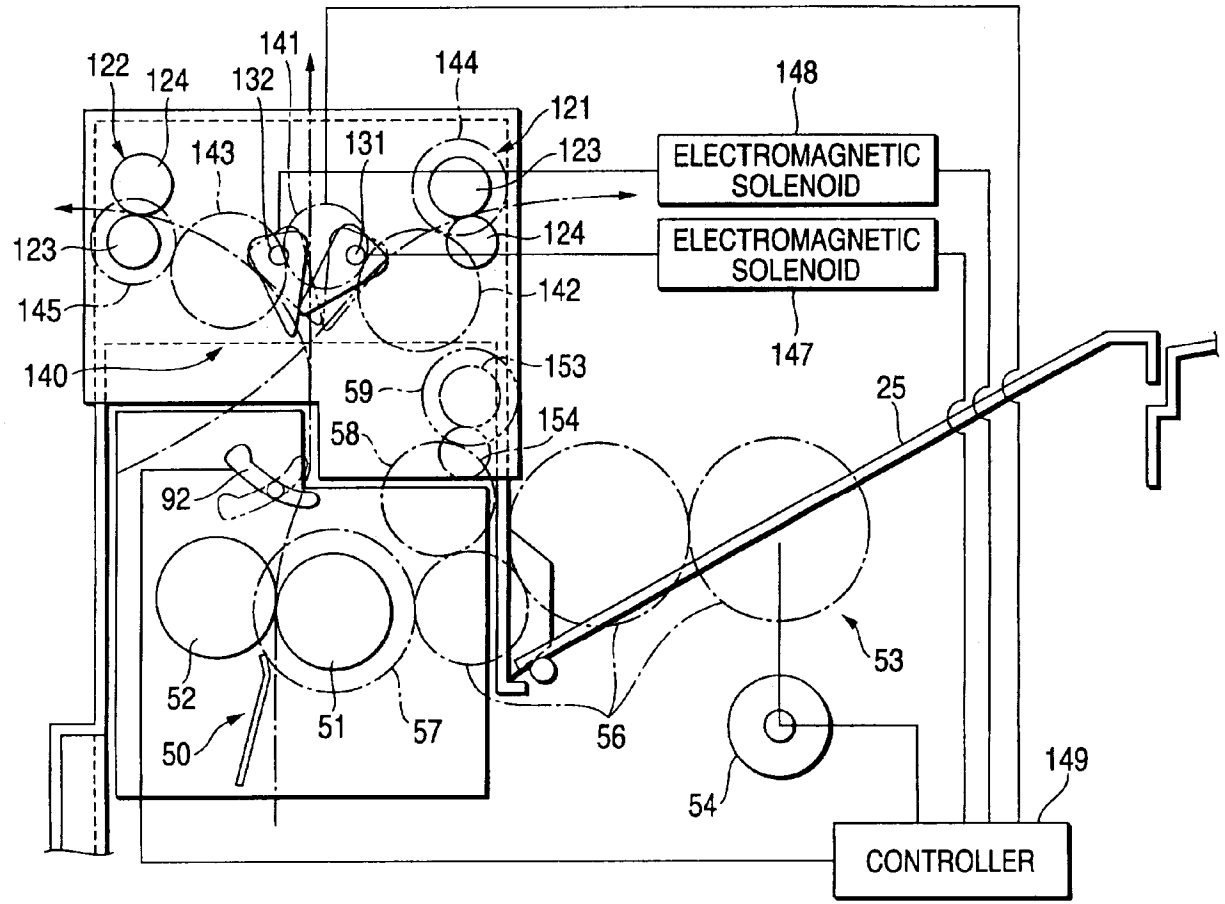
FIG. 7 is a schematic representation to show drive transmission systems of the sheet ejection apparatus according to the first embodiment of the invention.

Further, FIG. 7 shows a drive transmission system of the sheet ejection apparatus used in the embodiment.

In the figure, a drive transmission system 140 transmits a driving force from a drive motor 141 that can turn forward and reversely via a transmission gear 142 to a driven gear 144 placed coaxially with the drive ejection roll 123 of the first ejection roll pair 121 and also via a transmission gear 143 to a driven gear 145 placed coaxially with the drive ejection roll 123 of the second ejection roll pair 122.

In the embodiment, the fuser 50 comprises a heat fixing roll 51 containing a heating source and a pressurization fixing roll 52 for coming in contact with the heat fixing roll 51 for rotation at a predetermined nip pressure, and is driven by another drive transmission system 53.

That is, in the embodiment, the drive transmission system 53 meshes a driven gear 57 placed coaxially with the heat fixing roll 51 with a gear train 56 for forming a predetermined reduction gear ratio for transmitting a driving force from a drive motor 54 to the heat fixing roll 51.

Further, the drive transmission system 140 switches the switch gates 131 and 132 through electromagnetic solenoids 147 and 148.

The drive motor 141 and the electromagnetic solenoids 147 and 148 of the drive transmission system 140 are driven in response to a control signal following an image formation control program (containing a sheet ejection control program) from a controller 149. Sense signals from the sensors 91–93 and 95 and the like are input to the controller 149 and are used to generate the control signal.

The operation of the image formation apparatus according to the embodiment is as follow:

As shown in FIG. 3, in the image formation engine 21, a predetermined toner image is formed on the photoconductor drum 31 and on the other hand, a sheet is supplied from any of the sheet supply units 22 to 24 to the sheet transport passage 26 and the toner image on the photoconductor drum 31 is transferred onto the sheet by the transfer unit 35 and then the sheet on which the toner image is transferred undergoes fixing processing by the fuser 50 and then is ejected through the sheet ejection apparatus 60 to a predetermined ejection part.

The remaining toner on the photoconductor drum 31 is cleaned by the cleaning unit 36 for the next image formation cycle.

In such an image formation process, focusing attention on the sheet ejection apparatus 60, for example, ejection of a sheet is controlled in response to the following sheet ejection modes:

Face-Down Ejection Mode

This face-down ejection mode is a mode of ejecting a sheet S with the image side face down to the ejection tray 25.

Figure 8A:
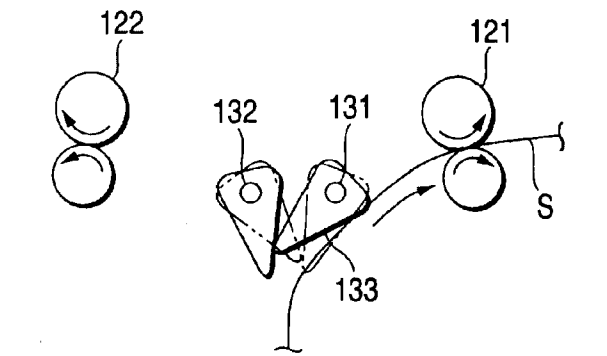
FIGS. 8A to 8D are schematic representations to show the sheet direction switch state of the sheet ejection apparatus according to the first embodiment of the invention.

At this time, the two switch gates 131 and 132 are switched as shown in FIG. 8A for blocking the second and third branch ejection passages 72 and 73, opening the first branch ejection passage 71, and guiding the sheet S along the guide face 133 of the first switch gate 131, and the first ejection roll pair 121 is forward rotated for executing nip transport of the sheet S (see FIG. 5).

Face-Up Ejection Mode

This face-up ejection mode is a mode of ejecting a sheet S with the image side face up to the face-up tray 62.

Figure 8B:
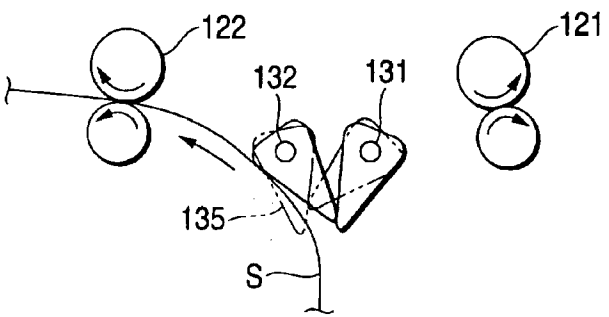

At this time, the two switch gates 131 and 132 are switched as shown in FIG. 8B for blocking the first and third branch ejection passages 71 and 73, opening the second branch ejection passage 72, and guiding the sheet S along the guide face 135 of the second switch gate 132, and the second ejection roll pair 122 is forward rotated for executing nip transport of the sheet S (see FIG. 5).

Particularly, when the face-up ejection mode is executed, the sheet S is curled in a predetermined direction when the sheet S passes through the fuser 50, but the second branch ejection passage 72 is extended in the direction correcting the curl of the sheet S, so that the curl of the sheet S can be corrected naturally without providing any additional curl correcting device.

OCT Ejection Mode

This OCT ejection mode is a mode of ejecting a sheet S to the OCT of the optional ejection unit 63.

Figure 8C:
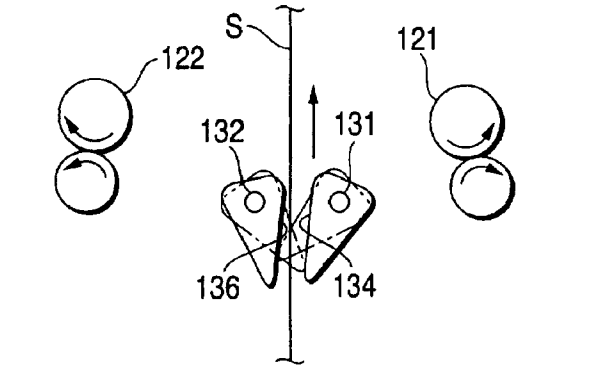

At this time, the two switch gates 131 and 132 are switched as shown in FIG. 8C for blocking the first and second branch ejection passages 71 and 72, opening the third branch ejection passage 73, and guiding the sheet S along the guide faces 134 and 136 of the first and second switch gates 131 and 132 (see FIG. 5).

Sheet Reversal Control in Double-Sided Record Mode

This is sheet transport control performed when a sheet S with an image already recorded on one side is returned to the double-sided record unit 80 in the double-sided record mode.

Figure 8D:
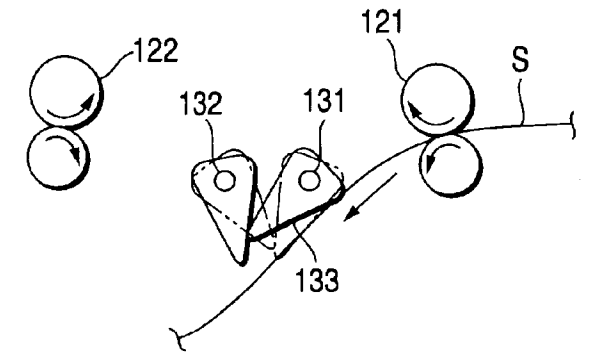

At this time, the two switch gates 131 and 132 are switched as shown in FIG. 8D for guiding the sheet S with an image already recorded on one side to the first branch ejection passage 71, and the first ejection roll pair 121 is forward rotated for executing nip transport of the sheet S in a predetermined amount and then when the sheet S exceeds the branch point P, forward rotation of the first ejection roll pair 121 is switched to reverse rotation. The sheet S nip-held on the first ejection roll pair 121 is transported on the first branch ejection passage 71 in the reverse direction, is guided to the double-sided record transport passage 75 communicating with the first branch ejection passage 71 roughly linearly, and is transported to the double-sided record unit 80 (see FIG. 5).

The operation timings of both the ejection roll pairs 121 and 122 and both the switch gates 131 and 132 are controlled based on a sense signal of the ejection sensor 92.

In the embodiment, if the opposed faces of the two switch gates 131 and 132 are formed like comb teeth so that the switch gates 131 and 132 are fitted into each other, for example, when the mode is switched from the face-down ejection mode to the face-up ejection mode, only the second switch gate 132 needs to be switched from the phantom line position to the solid line position as shown in FIG. 8B with the first switch gate 131 held intact at the position (the solid line position in FIG. 8A).

According to such a form, switch control of the switch gates 131 and 132 can be performed more easily.

Replacement of Sheet Ejection Unit

In the embodiment, the sheet ejection unit 61 can be attached to and detached from the unit reception section 100 of the apparatus main unit 20 and thus the sheet ejection unit 61 used in the embodiment comprises the configuration capable of ejecting sheets in the three directions. However, the sheet ejection unit 61 can be replaced with any sheet ejection unit 150 of various specifications such that sheets can be ejected in two directions, that sheets can be ejected only in one direction, or that the sheet ejection position is varied in response to the number of ejected sheets that can be stored.

Figure 9:
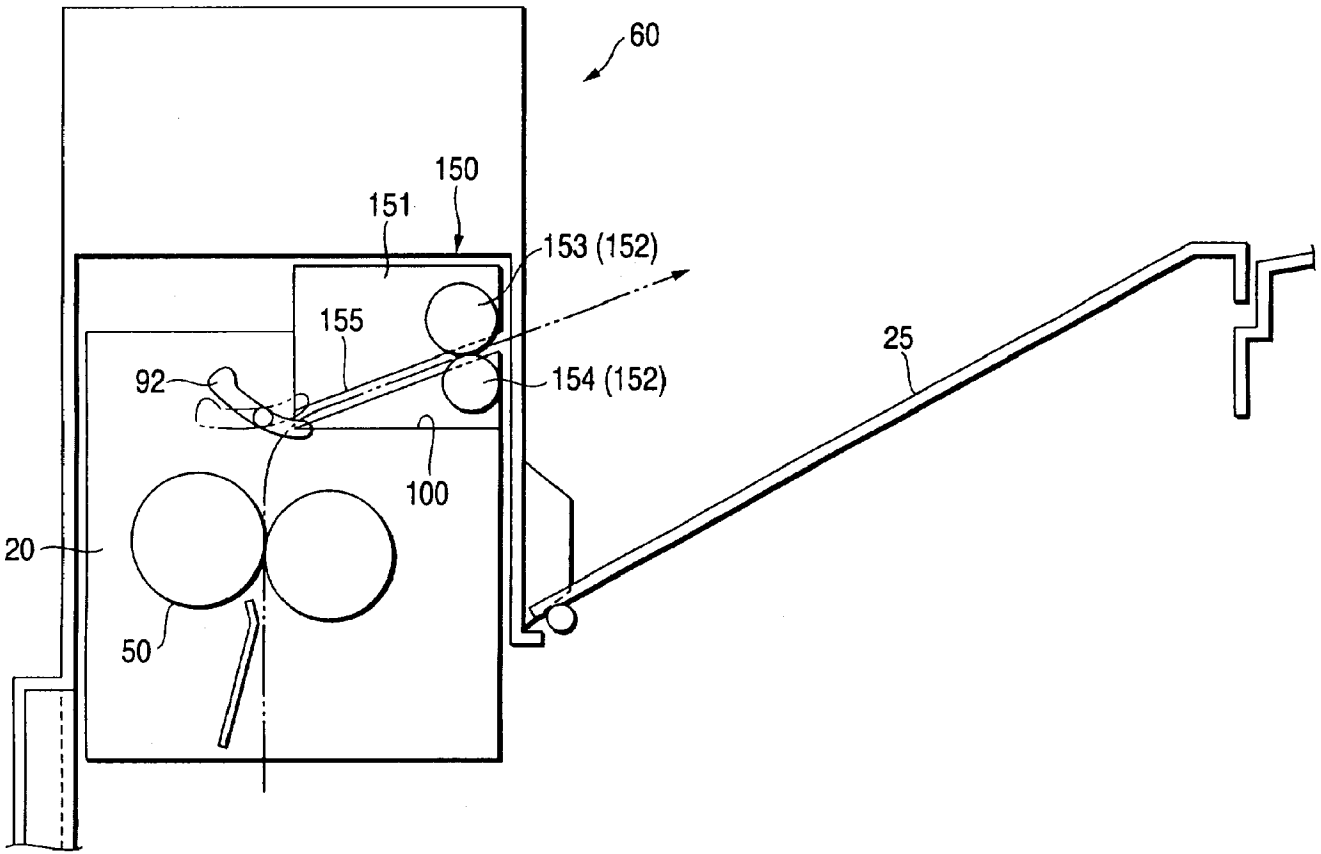
FIG. 9 is a schematic representation to show a state in which another sheet ejection unit is attached in the first embodiment of the invention.
Figure 10:
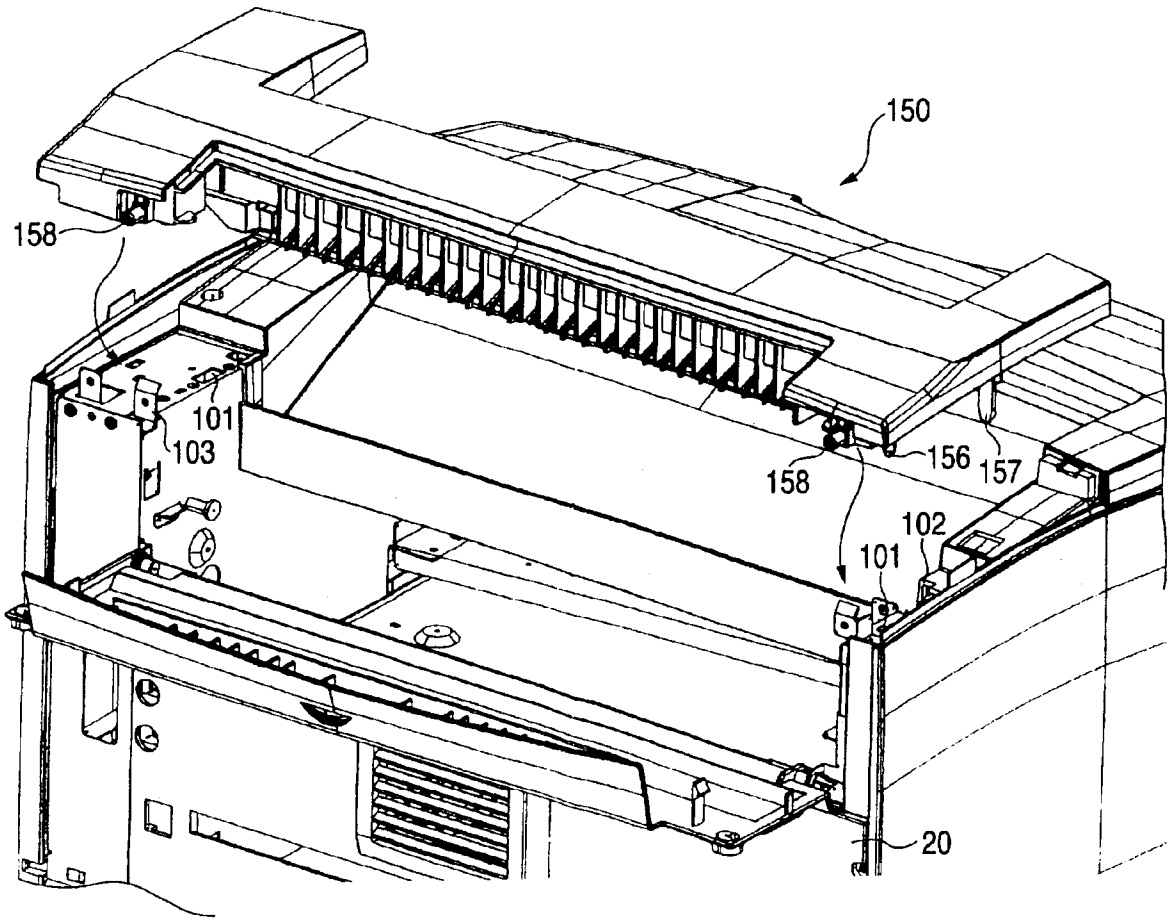
FIG. 10 is a perspective view of the main part to show details of the sheet ejection unit in FIG. 9.

For example, as shown in FIGS. 9 and 10, a sheet ejection unit 150 to eject sheets only in one direction is used.

The sheet ejection unit 150, for example, comprises a unit main body 151 provided with an ejection passage 155 extended in a predetermined direction and an ejection roll pair 152 consisting of a drive ejection roll 153 and a driven ejection roll 154 disposed in a part of the ejection passage 155.

The sheet ejection unit 150, for example, does not comprise its own drive source and a transmission gear 58 is meshed with a part of the drive transmission system 53 of the fuser 50 and a driven gear 59 placed coaxially with the drive ejection roll 153 is meshed with the transmission gear 58 for transmitting a driving force.

The sheet ejection unit 150 has engaged parts 156 to 158 engaged in or disengaged from the engagement parts 101 to 103 of the unit reception section 100, and the sheet ejection unit 61 can be easily replaced with the sheet ejection unit 150 different in specifications.

If the sheet ejection unit 61 is thus replaced with the sheet ejection unit 150, the ejection sensor 92 is placed in the apparatus main unit 20 and thus if the sheet ejection unit 150 different in specifications is attached, the position of the ejection sensor 92 does not change and therefore sheet ejection control is performed adopting a roughly similar control technique to that applied before the sheet ejection units are replaced.

Figure 11:
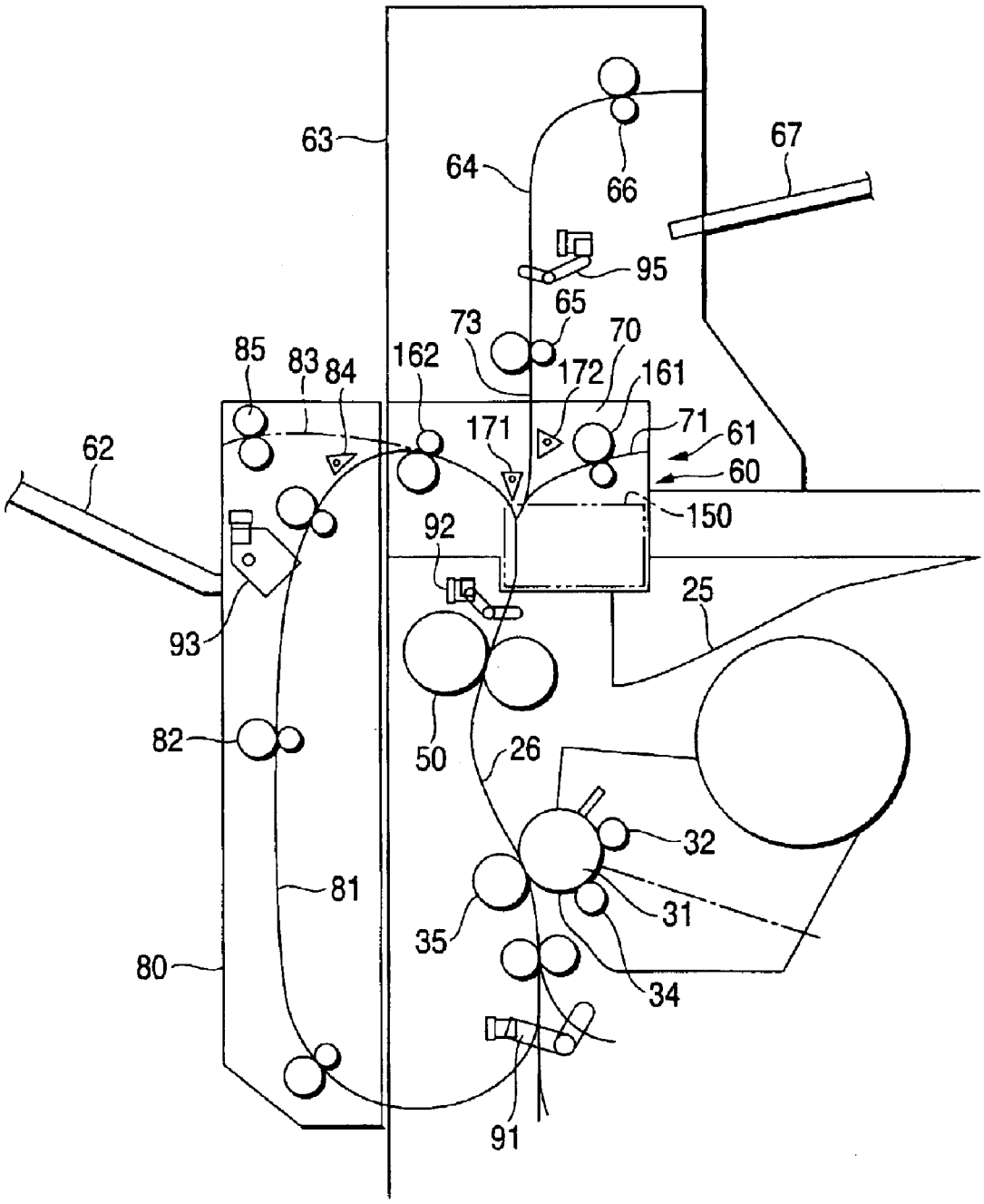
FIG. 11 is a schematic representation of the main part to show a second embodiment of a sheet processing apparatus incorporating the invention.

Second Embodiment:

FIG. 11 shows the main part of a second embodiment of a sheet processing apparatus (in the example, an image formation apparatus) incorporating the invention.

In the figure, the image formation apparatus has a basic configuration roughly similar to that of the first embodiment; they differ in configurations of double-sided record unit 80 and sheet ejection apparatus 60. Components similar to those previously described with reference to the preceding accompanying drawings are denoted by the same reference numerals in FIGS. 11 to 13 and will not be discussed again in detail.

In the second embodiment, a double-sided record unit 80 is disposed facing a side of a sheet ejection apparatus 60, a branch ejection passage 84 is placed via a switch gate 83 in a sheet return transport passage 81 of the double-sided record unit 80 positioned downstream from a second branch ejection passage 72 of a sheet ejection unit 61, an ejection roll 85 is placed in the exit of the branch ejection passage 84, and the branch ejection passage 84 communicates with a face-up tray 62.

Figure 12:
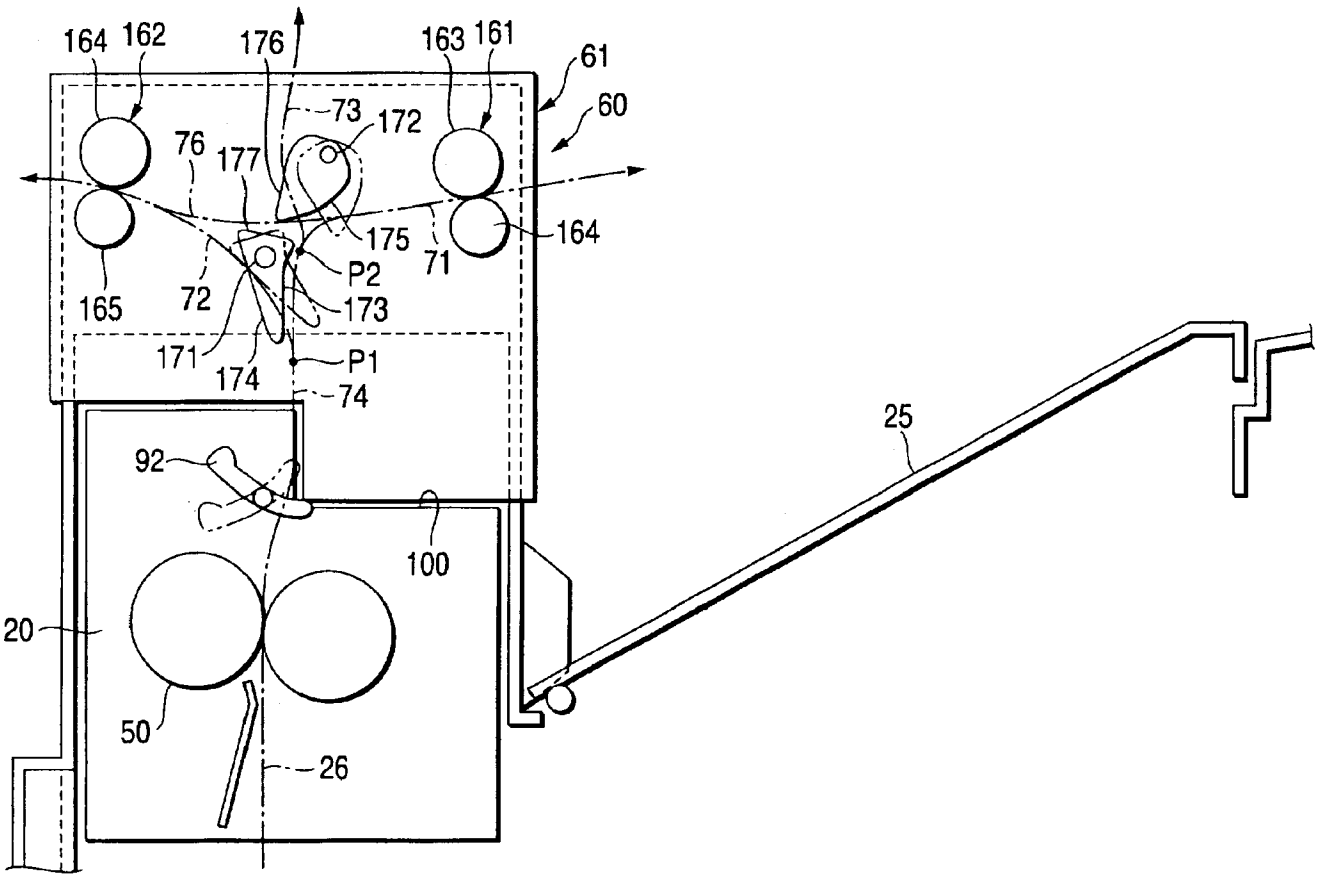
FIG. 12 is a schematic representation to show details of a sheet ejection apparatus used in the second embodiment of the invention.

As shown in FIGS. 11 and 12, the sheet ejection unit 61 has three branch ejection passages 71 to 73 branching in a unit main body 70 as in the first embodiment. However, unlike the sheet ejection unit 61 in the first embodiment, the second branch ejection passage 72 and other branch ejection passages are separated at a first branch point P1, the first and third branch ejection passages 71 and 73 are separated at a second branch point P2, a sheet carrying-in passage 74 extended downward to a fuser 50 is placed upstream from the branch point P1, and the first and second branch ejection passages 71 and 72 are made communicate with each other roughly linearly by a communication transport passage 76.

Ejection roll pairs 161 and 162 are disposed in the vicinities of the exits of the first and second branch ejection passages 71 and 72 and further switch gates 171 and 172 are placed in the vicinities of the branch points P1 and P2.

In the embodiment, the ejection roll pairs 161 and 162 comprise each a drive ejection roll 163 and a driven ejection roll 164 brought into contact with each other for rotation, and are driven in a roughly similar manner to that in the first embodiment. However, unlike the first embodiment, when the first ejection roll pair 161 is rotated reversely, the second ejection roll pair 162 is rotated forward.

The first switch gate 171 is made of a gate member shaped roughly like a triangle and comprises guide faces 173 and 174 provided by both sides of the gate member extended to the branch point P1, and a third guide face 177 provided by the remaining side. The first switch gate 171 is switched swingably between a position indicated by the solid line (the position for blocking the second branch ejection passage 72 and guiding a sheet along the guide face 173 to a merging passage of the first and third branch ejection passage 71 and 73) and a position indicated by the phantom line (the position for blocking the merging passage communicating with the first and third branch ejection passage 71 and 73 and guiding a sheet along the guide face 174 of the first switch gate 171 to the second branch ejection passage 72).

On the other hand, likewise the second switch gate 172 is made of a gate member shaped roughly like a triangle and comprises guide faces 175 and 176 provided by both sides of the gate member extended to the branch point P2. The second switch gate 172 is switched swingably between a position indicated by the solid line (the position for blocking the third branch ejection passage 73 and guiding a sheet along the guide face 175 of the second switch gate 172 to the first branch ejection passage 71) and a position indicated by the phantom line (the position for blocking the first branch ejection passage 71 and guiding a sheet along the guide face 176 of the second switch gate 172 to the third branch ejection passage 73).

The operation of the image formation apparatus according to the embodiment is as follow:

In the embodiment, an image formation process is executed in a roughly similar manner to that in the first embodiment.

In such an image formation process, focusing attention on the sheet ejection apparatus 60, for example, ejection of a sheet is controlled in response to the following sheet ejection modes:

Face-Down Ejection Mode

This face-down ejection mode is a mode of ejecting a sheet S with the image side face down to an ejection tray 25.

Figure 13A:
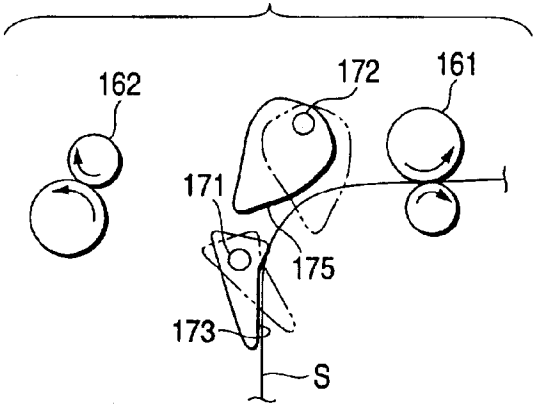
FIGS. 13A to 13D are schematic representations to show the sheet direction switch state of the sheet ejection apparatus according to the second embodiment of the invention.

At this time, the two switch gates 171 and 172 are switched as shown in FIG. 13A for blocking the second branch ejection passage 72 by the first switch gate 171, blocking the third branch ejection passage 73 by the second switch gate 172, opening the first branch ejection passage 71, and guiding the sheet S along the guide face 175 of the second switch gate 172, and the first ejection roll pair 161 is forward rotated for executing nip transport of the sheet S (see FIG. 12).

Face-Up Ejection Mode

This face-up ejection mode is a mode of ejecting a sheet S with the image side face up to the face-up tray 62.

Figure 13B:
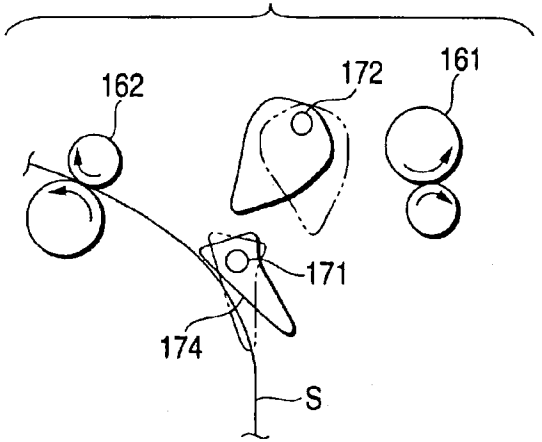

At this time, the two switch gates 171 and 172 are switched as shown in FIG. 13B for blocking the second and third branch ejection passages 72 and 73 by the first switch gate 171, opening the second branch ejection passage 72, and guiding the sheet S along the guide face 174 of the first switch gate 171, and the second ejection roll pair 162 is forward rotated for executing nip transport of the sheet S (see FIG. 12).

At this time, the second switch gate 172 may be set arbitrarily regardless of the solid line position or the phantom line position.

The sheet S ejected from the second branch ejection passage 72 arrives at the sheet return transport passage 81, passes through the branch ejection passage 84, and is ejected through the ejection roll 85 to the face-up tray 62.

OCT Ejection Mode

This OCT ejection mode is a mode of ejecting a sheet S to the OCT of an optional ejection unit 63.

Figure 13C:
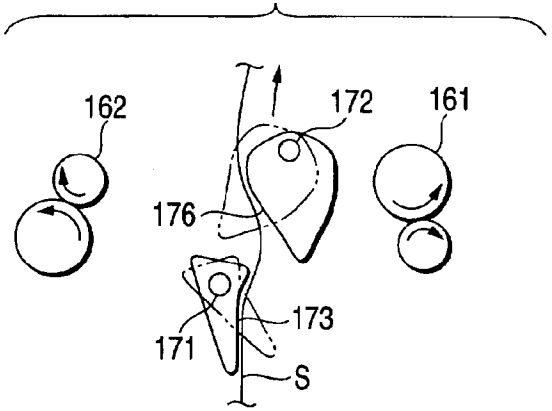

At this time, the two switch gates 171 and 172 are switched as shown in FIG. 13C for blocking the second branch ejection passage 72 by the first switch gate 171, blocking the first branch ejection passage 71 by the second switch gate 172, opening the third branch ejection passage 73, and guiding the sheet S along the guide faces 173 and 176 of the first and second switch gates 171 and 172 (see FIG. 12).

Sheet Reversal Control in Double-Sided Record Mode

This is sheet transport control performed when a sheet S with an image already recorded on one side is returned to the double-sided record unit 80 in the double-sided record mode.

Figure 13D:
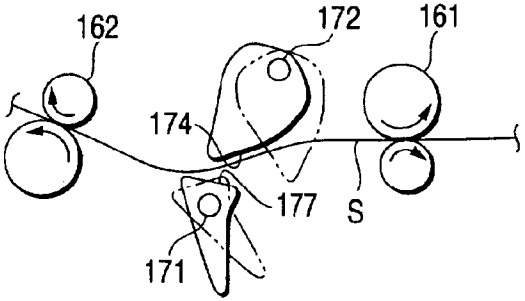

At this time, the two switch gates 171 and 172 are switched as shown in FIG. 13D for guiding the sheet S with an image already recorded on one side to the first branch ejection passage 71, and the first ejection roll pair 161 is forward rotated for executing nip transport of the sheet S in a predetermined amount and then when the sheet S exceeds the second branch point P2, forward rotation of the first ejection roll pair 161 is switched to reverse rotation. The sheet S nip-held on the first ejection roll pair 161 is transported on the first branch ejection passage 71 in the reverse direction, is guided along the guide face 174 of the second switch gate 172 and the third guide face 177 of the first switch gate 171 to the communication transport passage 76 communicating with the first branch ejection passage 71 roughly linearly, and is transported to the double-sided record unit 80 as the second ejection roll pair 162 is forward rotated (see FIG. 12).

After this, as shown in FIG. 11, the sheet S ejected from the second branch ejection passage 72 passes through the sheet return transport passage 81 and is reversed by the double-sided record unit 80. In this state, the sheet S again arrives at a registration roll 44 and is submitted for the image formation process of the image formation engine 21.

Figure 14:
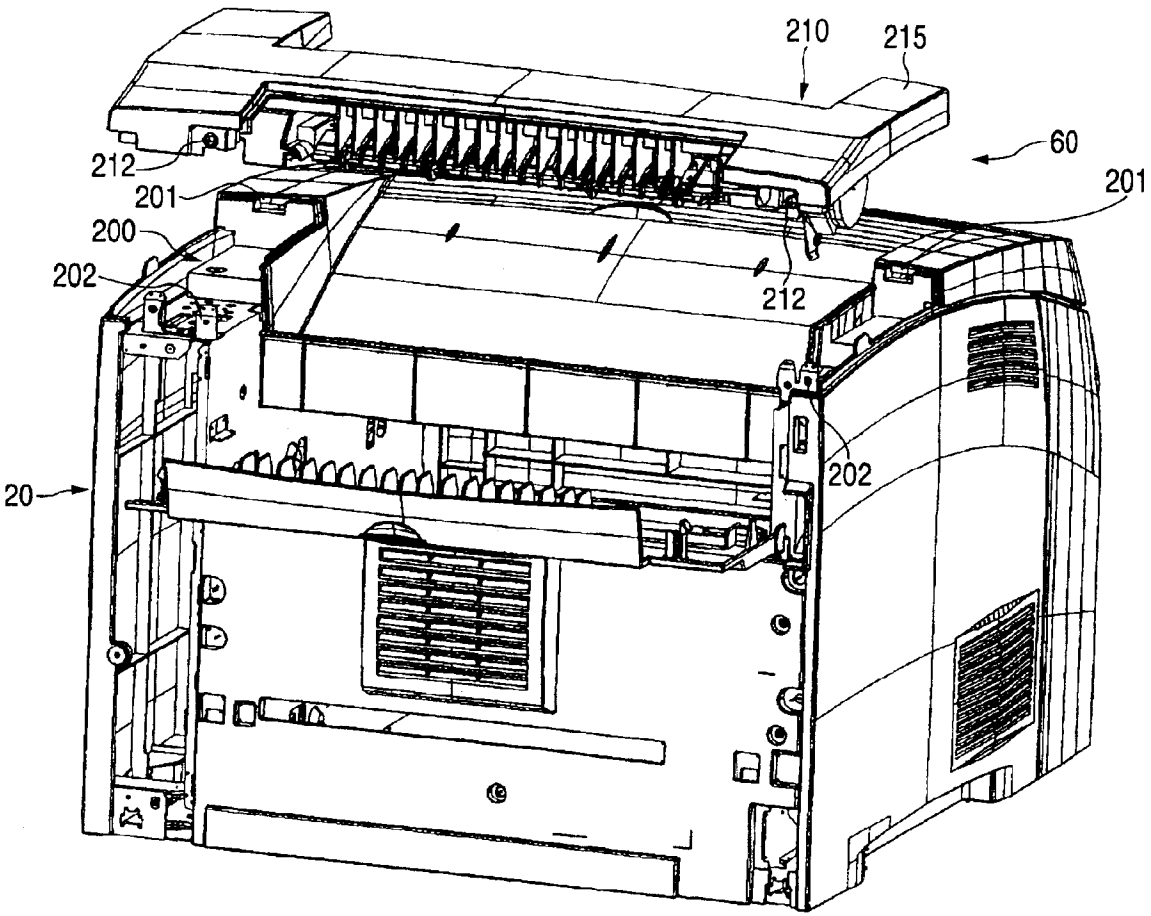
FIG. 14 is a schematic representation to show a sheet ejection apparatus according to a third embodiment of the invention.

Third Embodiment:

FIG. 14 shows a third embodiment of a sheet ejection apparatus incorporating the invention.

In the figure, a sheet ejection apparatus 60 differs from the sheet ejection apparatus in the first embodiment (the attachment structure of the sheet ejection unit to the unit reception section 100 is made common to the sheet ejection units 61 and 150 different in specifications) in that sheet ejection units 210 and 220 different in specifications (see FIG. 16) are provided each with an engagement part, and a unit reception section 200 is provided with separate engaged parts corresponding to the engagement parts of the sheet ejection units 210 and 220.

In the embodiment, the sheet ejection capacity of the sheet ejection unit 210 or 220 is set variably in response to the sheet transport speed, the sheet supply amount, or the sheet processing amount (image formation amount) of an apparatus main unit 20. In the example, the sheet ejection capacity of one sheet ejection unit 210 is set to about 250 and that of the other sheet ejection unit 220 is set to about 500.

In the example, one sheet ejection unit 210 is formed integrally with an exterior cover 215, while the other sheet ejection unit 220 is formed separately from an exterior cover 225; this design item can be selected whenever necessary.

Figure 15:
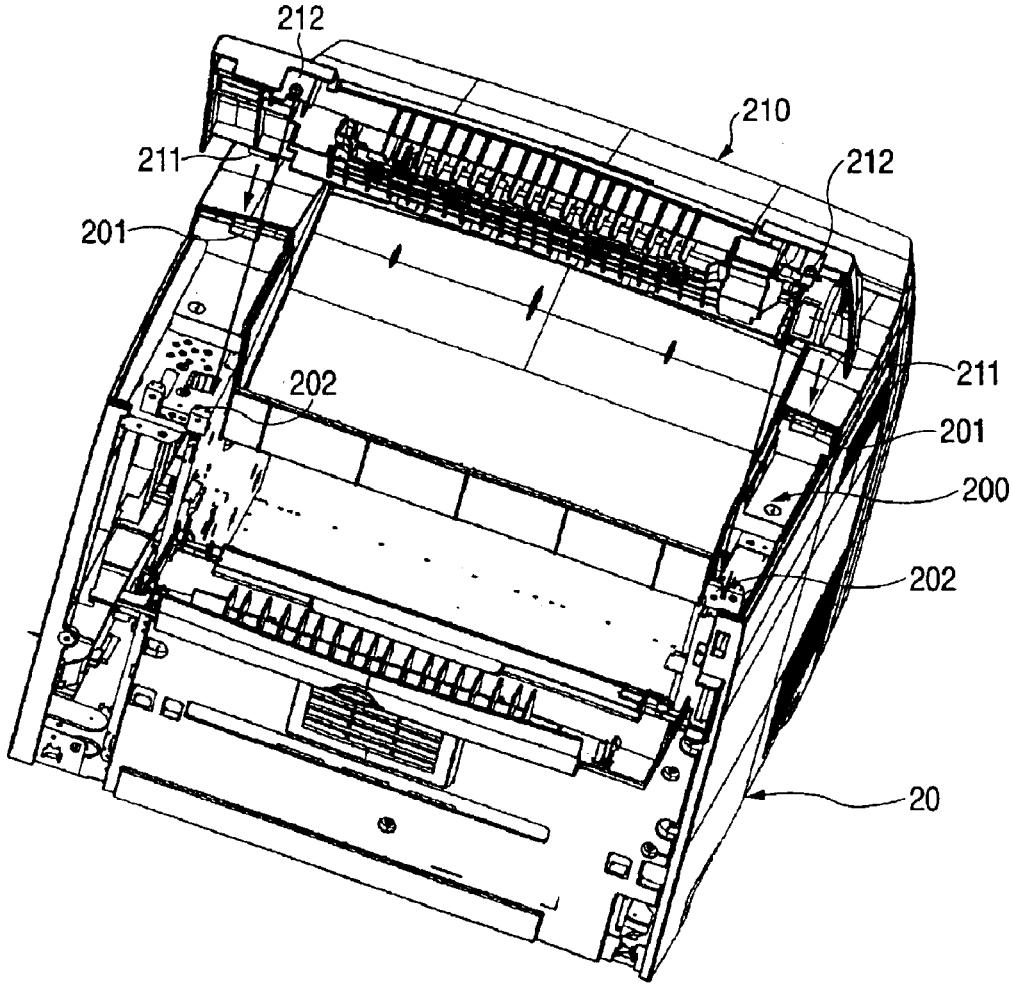
FIG. 15 is a schematic representation to show the attachment structure of the sheet ejection apparatus in FIG. 14.

As shown in FIGS. 14 and 15, the sheet ejection unit 210 is provided with positioning pieces 211 and screw mounting pieces 212 at appropriate positions and on the other hand, the unit reception section 200 is provided with positioning holes 201 into which the positioning pieces 211 are fitted, and screw pieces 202 that the screw mounting pieces 212 abut.

Figure 16:
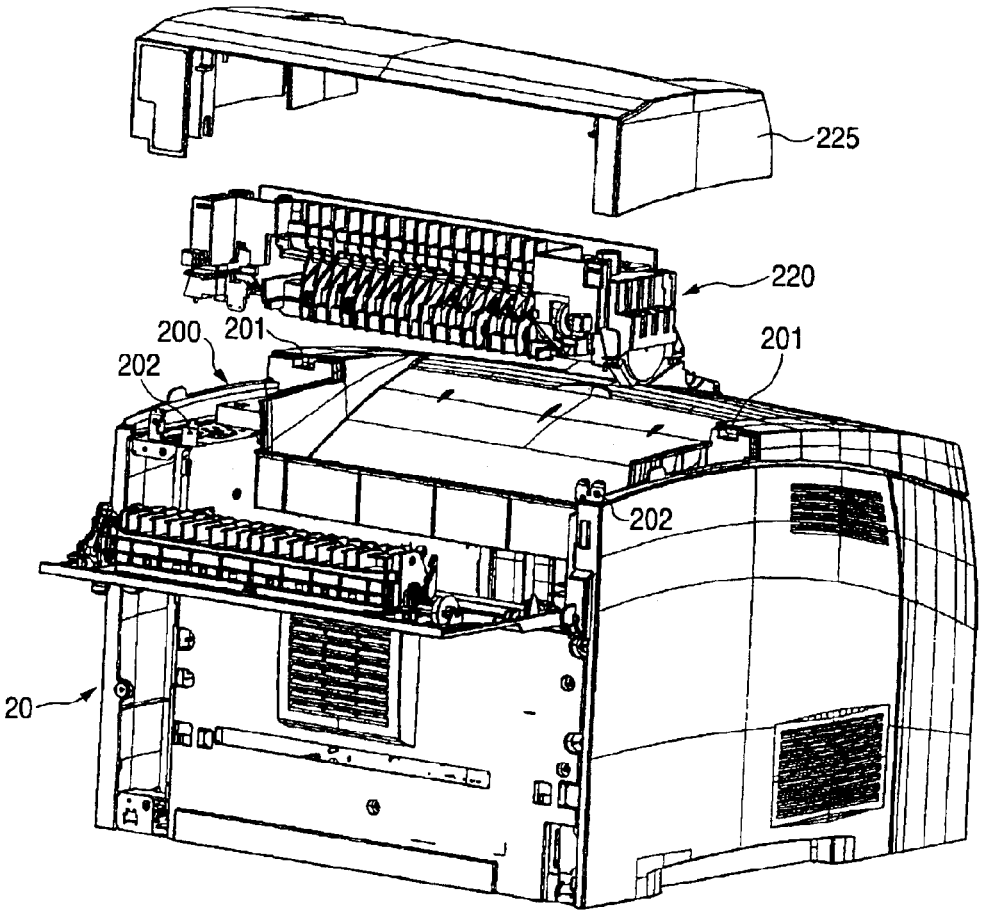
FIG. 16 is a schematic representation to show placement of a sheet ejection unit of different specifications in the third embodiment of the invention.
Figure 17:
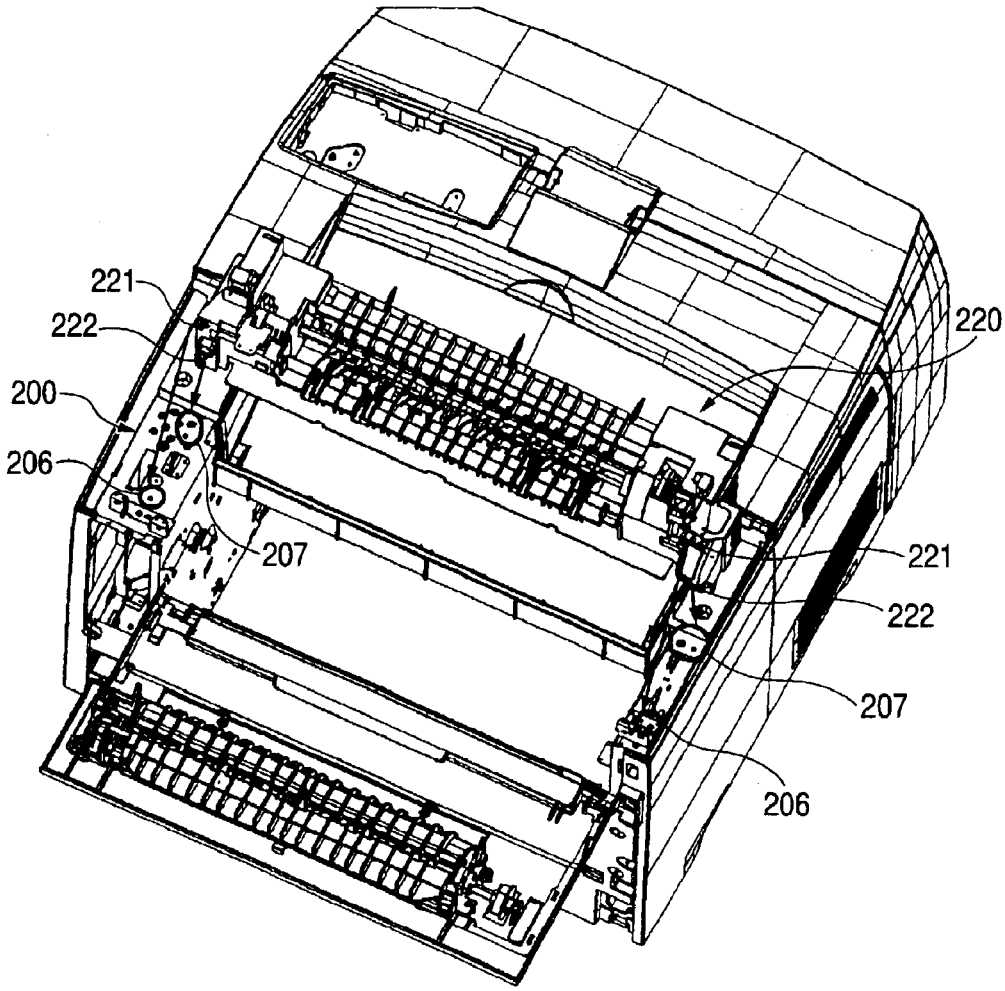
FIG. 17 is a schematic representation to show the attachment structure of the sheet ejection unit in FIG. 16.
Figure 18:
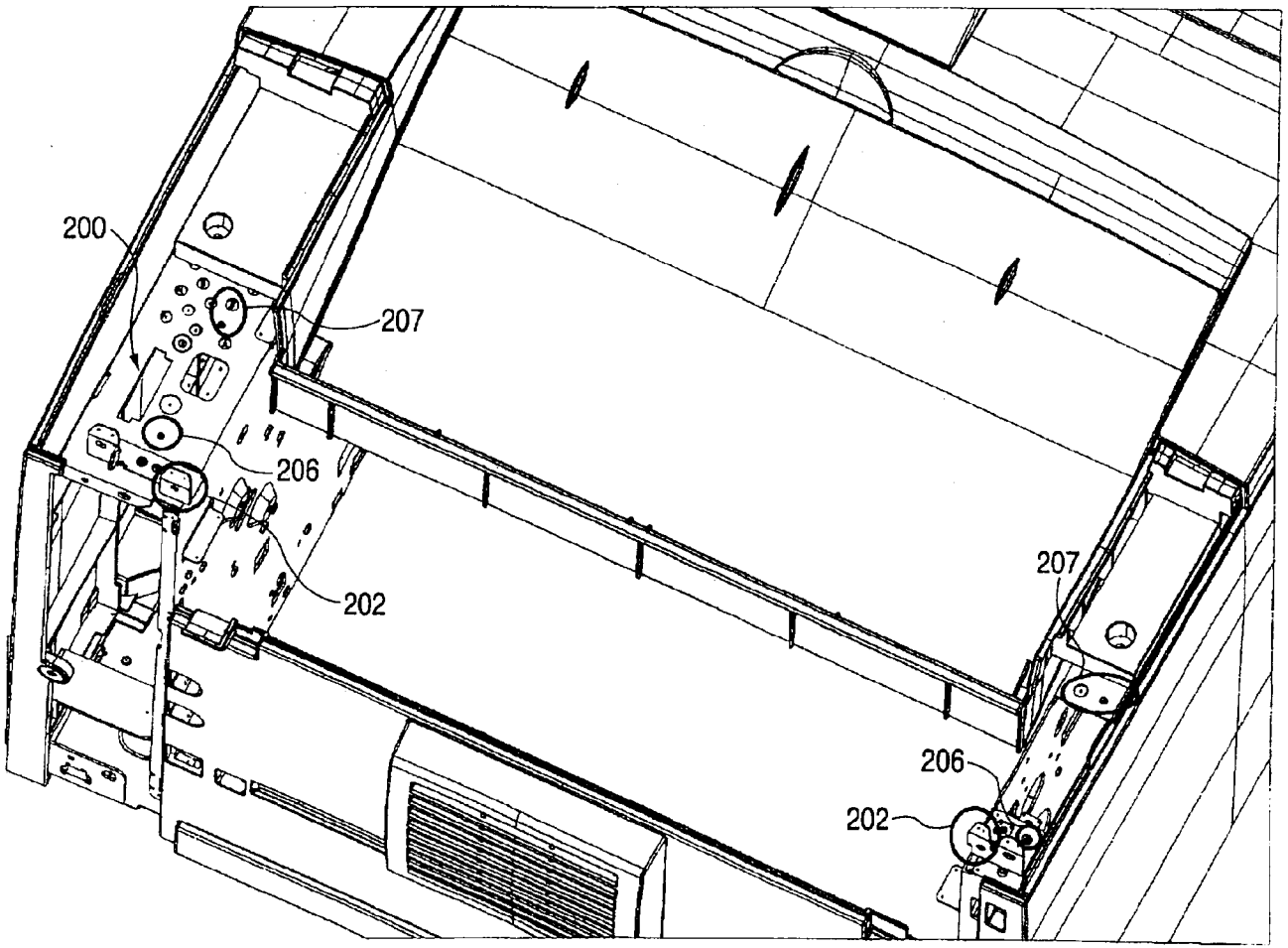
FIG. 18 is a schematic representation to show details of attachment parts of a unit reception section in the third embodiment of the invention.

As shown in FIGS. 16 to 18, the sheet ejection unit 220 different in specifications from the sheet ejection unit 210 is formed with positioning bosses 221 and retention protrusions 222 for attachment, the positioning bosses 221 and the retention protrusions 222 being projected downward, and on the other hand, the unit reception section 200 is provided with positioning holes 206 into which the positioning bosses 221 are fitted, and retention holes 207 into which the retention protrusions 222 are fitted.

Therefore, in the embodiment, the unit reception section 200 has separate engaged parts (201, 202, 206, and 207) corresponding to the engagement parts (211 and 212 and 221 and 222) of the sheet ejection units 210 and 220, and each sheet ejection unit 210, 220 is attached detachably to the unit reception section 200 as the engagement parts are engaged in the corresponding engaged parts.

In the embodiment, the engaged parts of the unit reception section 200 corresponding to the engagement parts of the sheet ejection units 210 and 220 are provided completely as separate parts, but some may be shared between the sheet ejection units 210 and 220.

Figure 19:
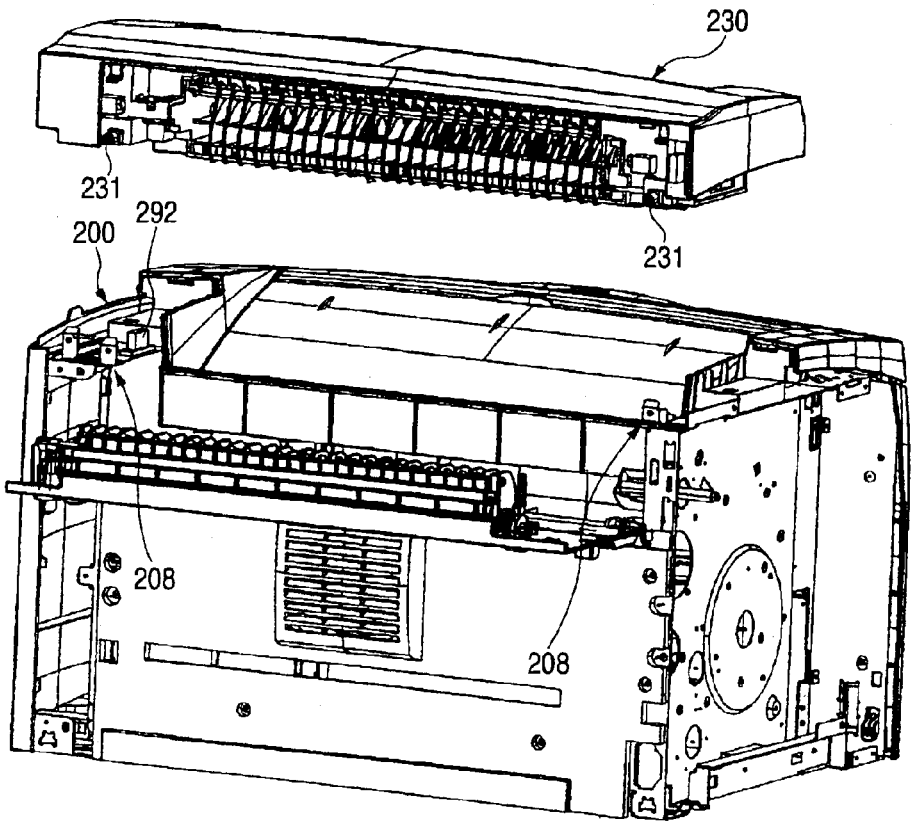
FIG. 19 is a schematic representation to show a sheet ejection apparatus according to a fourth embodiment of the invention.

Fourth Embodiment:

FIG. 19 is a schematic representation to show a fourth embodiment of a sheet ejection apparatus according to the invention.

Figure 20:
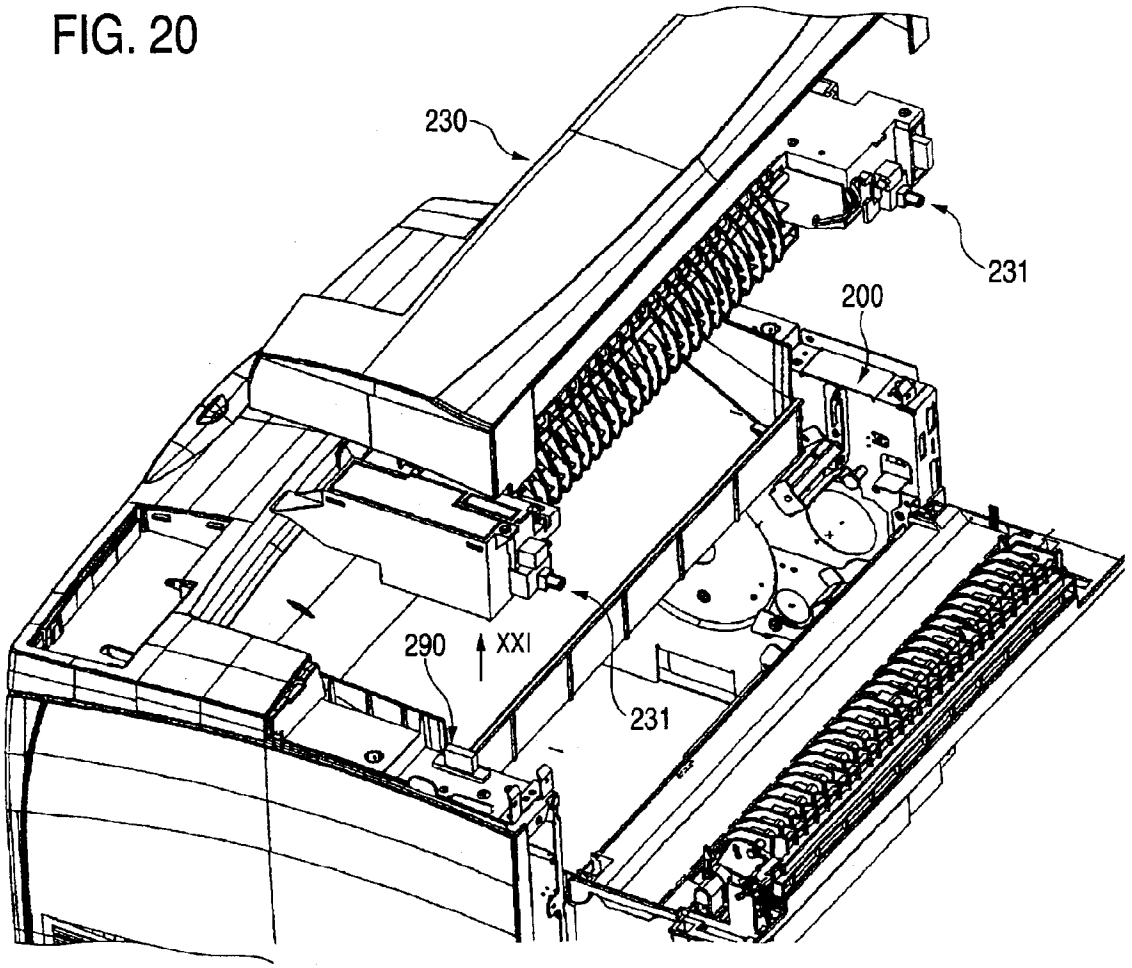
FIG. 20 is a schematic representation to show electric connection of a processing apparatus main unit and the sheet ejection apparatus.
Figure 21:
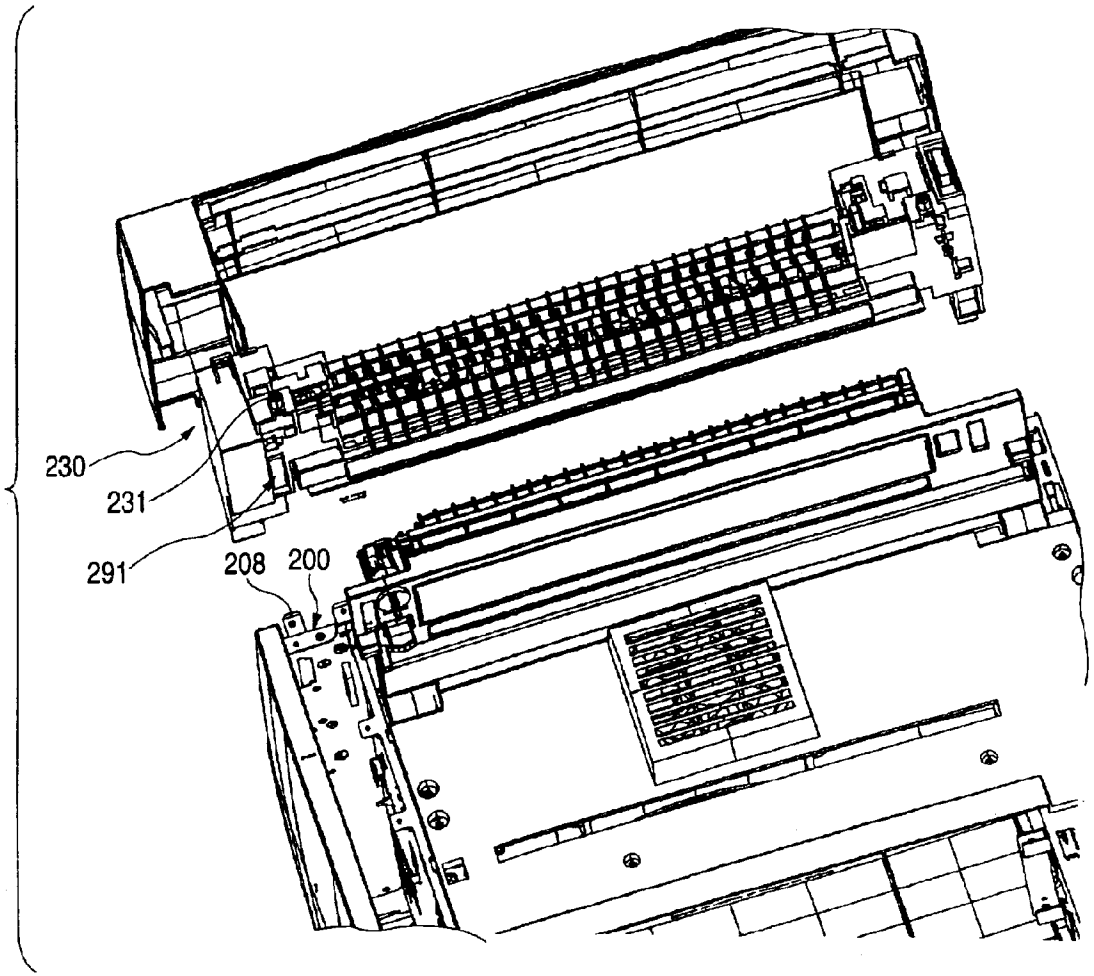
FIG. 21 is an arrow view from arrow XXII direction in FIG. 20.

In the figure, the sheet ejection apparatus comprises a sheet ejection unit 230 attached detachably to a unit reception section 200 in a roughly similar manner to that in the third embodiment; the sheet ejection apparatus differs from that in the third embodiment in that it has a structure of electrically connecting the sheet ejection unit 230 and an apparatus main unit 20 when the sheet ejection unit 230 is attached to the unit reception section 200. In FIGS. 19 to 21, numeral 208 denotes a screw piece formed on the unit reception section 200 and numeral 231 denotes a screw recess.

That is, in the embodiment, an electric connection terminal 290 of the apparatus main unit 20 is exposed in a part of the unit reception section 200 and a drawer connector 291 is placed in a part of the sheet ejection unit 230 opposed to the electric connection terminal 290. When the sheet ejection unit 230 is attached to the unit reception section 200, the electric connection terminal 290 and the drawer connector 291 are connected for supplying power from the apparatus main unit 20 to the sheet ejection unit 230.

Accordingly, if the sheet ejection unit 230 is provided with various driven members, an appropriate driving force is given to each driven member as the power is supplied.

Figure 22:
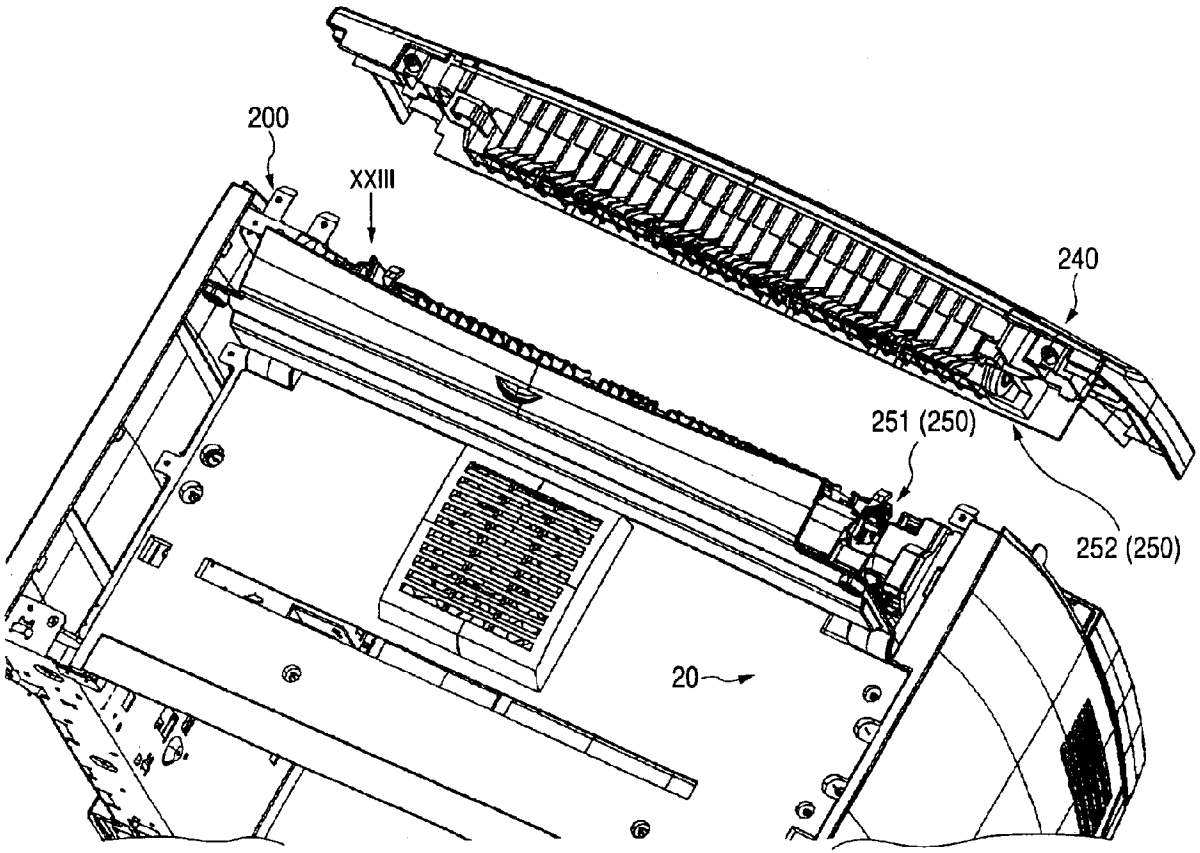
FIG. 22 is a schematic representation to show a sheet ejection apparatus according to a fifth embodiment of the invention.

Fifth Embodiment:

FIG. 22 shows a fifth embodiment of a sheet ejection apparatus according to the invention.

In the figure, the sheet ejection apparatus comprises a sheet ejection unit 240 attached detachably to a unit reception section 200 in a roughly similar manner to that in the third embodiment; the sheet ejection apparatus differs from that in the third embodiment in that a driving force transmission mechanism 250 to the sheet ejection unit 240 is stopped in a state in which the sheet ejection unit 240 is detached from the unit reception section 200.

Figure 23:
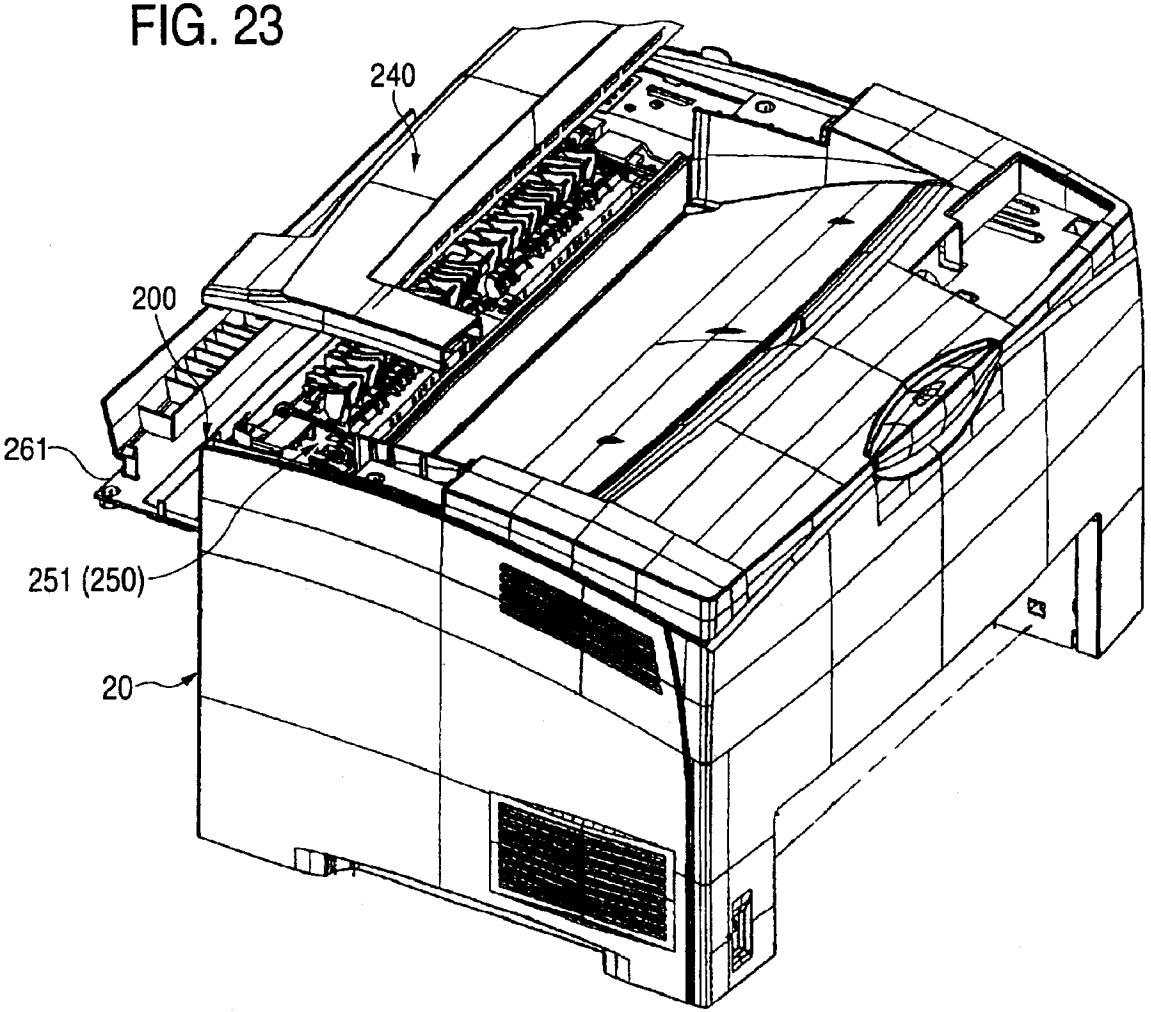
FIG. 23 is an arrow view from arrow XXIII direction in FIG. 22.

In the embodiment, as shown in FIGS. 22 and 23, the driving force transmission mechanism 250 comprises a main unit transmission mechanism 251 for transmitting a driving force from a drive source of an apparatus main unit 20 and a unit transmission mechanism 252 being placed in the sheet ejection unit 240 for transmitting the driving force through the main unit transmission mechanism 251 to driven members, such as an ejection roll and a switch gate. When the sheet ejection unit 240 is attached to the unit reception section 200, both the transmission mechanisms 251 and 252 engage each other and are placed in a transmittable mode of the driving force.

Figure 24:
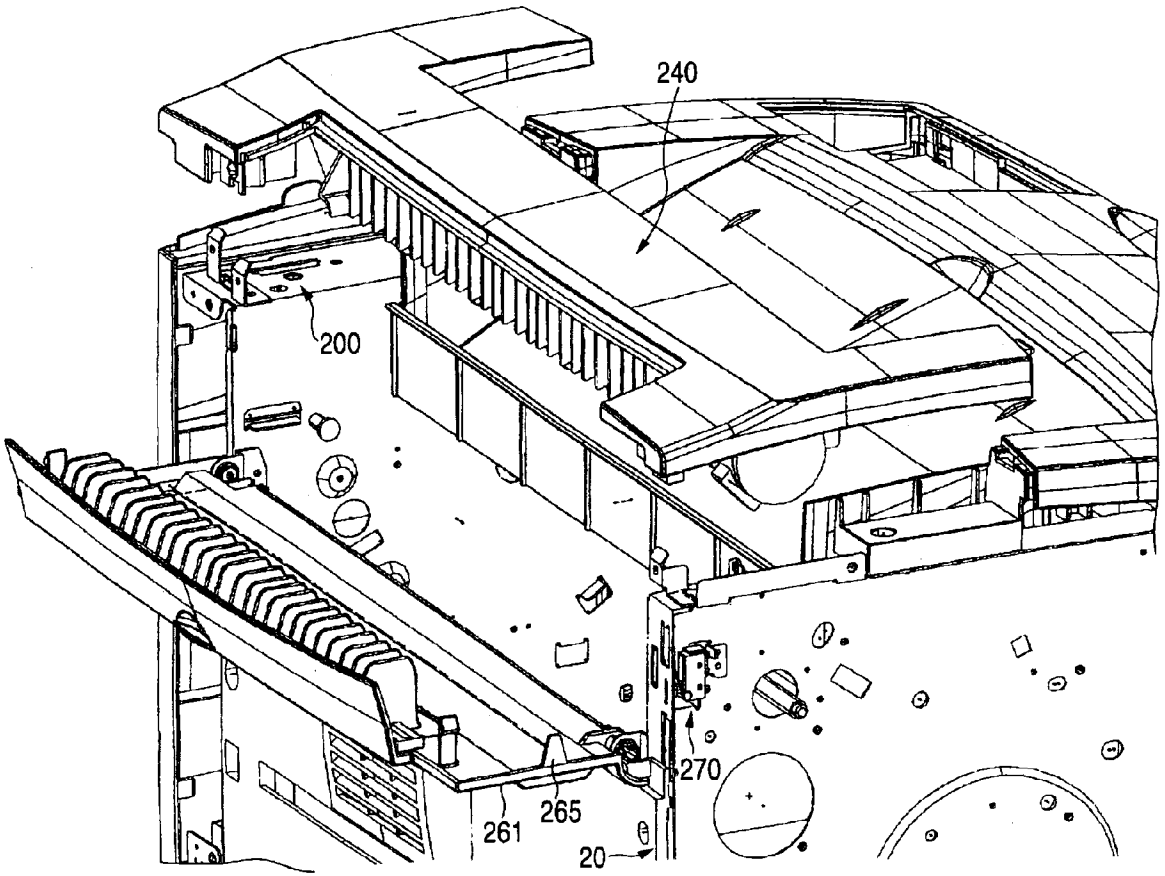
FIG. 24 is a schematic representation to show an interlocking device used in the fifth embodiment of the invention.
Figure 25:
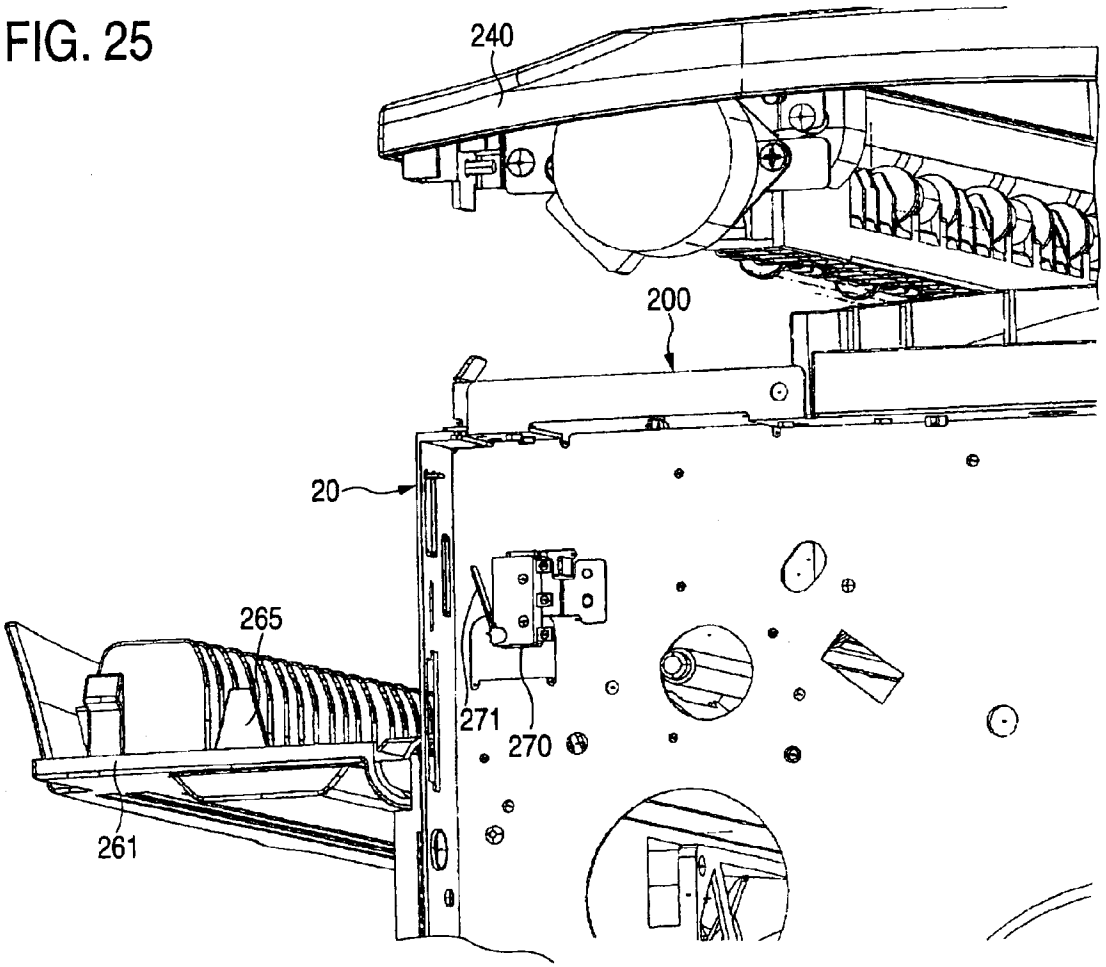
FIG. 25 is a schematic representation to show the state of the interlocking device when a cover member is opened.
Figure 26:
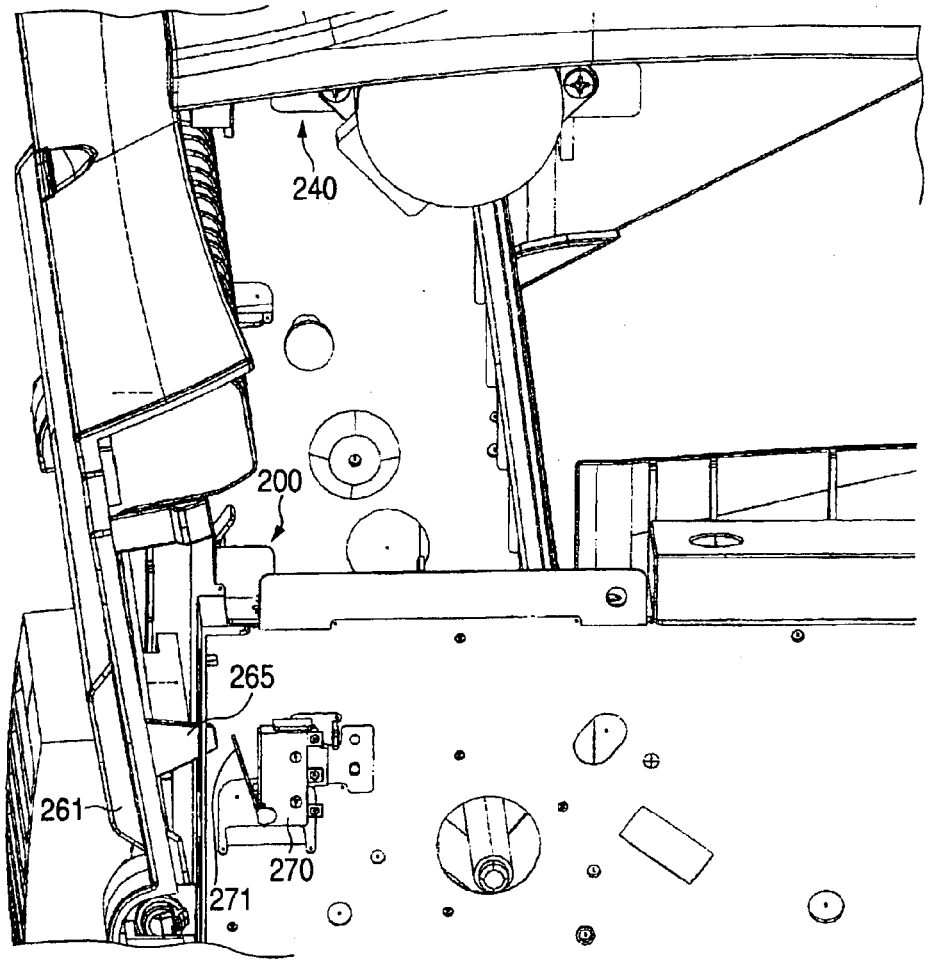
FIG. 26 is a schematic representation to show the state of the interlocking device when the cover member is closed.

In the embodiment, as shown in FIGS. 24 to 26, the sheet ejection apparatus comprises an open/closed cover 261 that can be opened and closed, being placed on the apparatus main unit 20 for allowing the sheet ejection unit 240 to be attached or detached through an opening when the cover is open, and an interlocking device 270 for enabling the apparatus main unit 20 to operate in a state in which the open/closed cover 261 is closed and disabling operation of the apparatus main unit 20 in a state in which the open/closed cover 261 is open. The interlocking device 270 is used to determine whether or not the sheet ejection unit 240 is detached from the apparatus main unit 20. Numeral 265 denotes a switch piece placed on the open/closed cover 261 and numeral 271 denotes an operation piece of the interlocking device 270.

Therefore, according to the embodiment, to detach the sheet ejection unit 240 from the unit reception section 200, usually the open/closed cover 261 adjacent to the sheet ejection unit 240 is opened and then the sheet ejection unit 240 is detached. Thus, to detach the sheet ejection unit 240, the open/closed cover 261 is always opened.

At this time, the interlocking device 270 is turned off, disabling operation of the apparatus main unit 20 and thus the drive source is stopped and accordingly the main unit transmission mechanism 251 of the driving force transmission mechanism 250 stops. The main unit transmission mechanism 251 can also be stopped, for example, through a clutch, etc., without stopping the drive source.

Thus, if the sheet ejection unit 240 is detached from the unit reception section 200, the driving force transmission mechanism 250 stops, so that the sheet ejection unit 240 is detached safely.

In the embodiment, if the open/closed cover 261 is closed with the sheet ejection unit 240 detached, the interlocking device 270 is turned on, enabling the apparatus main unit 20 to operate.

Figure 27:
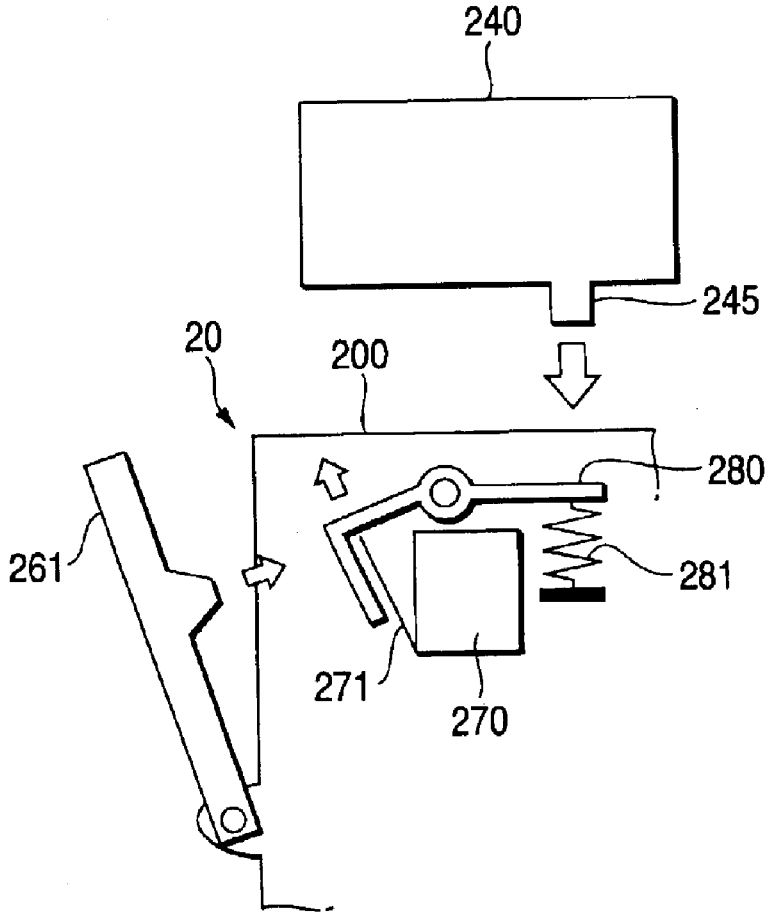
FIG. 27 is a schematic representation to show a form wherein a protective shutter is added to the interlocking device.

From the viewpoint of more enhancing safety, for example, as shown in FIG. 27, a shutter 280 is placed in the surrounding of the interlocking device 270 so that it can be opened and closed, normally the shutter 280 is urged in a predetermined direction by an urging spring 281 so that the shutter 280 is placed between the interlocking device 270 and the open/closed cover 261; on the other hand, when the sheet ejection unit 240 is attached to the unit reception section 200, the shutter 280 is moved against the urging spring 281 by a moving protrusion piece 245 placed on the sheet ejection unit 240 and may be retracted from between the interlocking device 270 and the open/closed cover 261.

According to the embodiment, when the sheet ejection unit 240 is attached, the interlocking device 270 is turned on/off in association with the opening/closing operation of the open/closed cover 261; when the sheet ejection unit 240 is detached, the shutter 280 obstructs the closing operation of the open/closed cover 261 and thus the interlocking device 270 is set to off (inoperable state) all the time.

Thus, when the sheet ejection unit 240 is attached or detached, the apparatus main unit 20 is held inoperable all the time and there is no fear of turning on the interlocking device 270 as the open/closed cover 261 is closed in error, and the sheet ejection unit 240 is attached or detached extremely safely.

As described above, according to the invention, the sheet ejection units different in specifications can be attached to the unit reception section of the processing apparatus main unit, so that it is made possible to attach the sheet ejection unit in response to the user's demand, and the number of ejected sheets that can be stored (ejected sheet capacity) can be changed easily.

According to another form of the invention, the sheet ejection unit is attached detachably to the unit reception section of the processing apparatus main unit. Thus, for example, if the sheet ejection units different in specifications are provided, it is made possible to replace the sheet ejection unit in response to the user's demand, and the ejected sheet capacity can be changed easily.

As the ejected sheet capacity can be changed easily, the sheet processing apparatus using the sheet ejection apparatus can easily follow change in the sheet processing capability specifications.

Further, to increase the ejected sheet capacity, the sheet ejection unit built in as a part of the processing apparatus main unit can be attached, so that the height of the sheet processing apparatus can be suppressed and miniaturization of the apparatus itself can be ensured.

Further, if the ejected sheet capacity is increased, the sheet ejection unit can follow it, so that parts of an additional sheet tray, etc., become unnecessary and the cost can be decreased accordingly.

A plurality of types of parts other than the sheet ejection unit are provided as required and to make the sheet ejection unit common for use, the cost can also be decreased.

What is claimed is:

1. A sheet ejection apparatus comprising:

a first sheet ejection unit having a first configuration;

a second sheet ejection unit having a second configuration different than the first configuration, wherein one of the first sheet ejection unit and the second sheet ejection unit is built in as a part of a processing apparatus main unit for ejecting a sheet processed by a processing section in the processing apparatus main unit through a sheet transport passage to a sheet stack section proximate a top surface of the processing apparatus main unit, and wherein the processing apparatus main unit includes a unit reception section, each one off the first sheet ejection unit and the second sheet ejection unit is attachable to the unit reception section.

2. The sheet ejection apparatus as claimed in claim 1 wherein the one of the first sheet ejection unit and the second sheet ejection unit can be attached to and detached from the unit reception section.

3. The sheet ejection apparatus as claimed in claim 1 wherein the one of the first sheet ejection unit and the second sheet ejection unit comprises an ejection member disposed proximate the sheet stack section so that a sheet that is ejected by the ejection member is stacked on the sheet stack section.

4. The sheet ejection apparatus as claimed in claim 3 wherein the first sheet ejection unit has a first height dimension, and the second ejection unit has a second height dimension different than the first height dimension, the first and second height dimensions being measured from the sheet stack section to the ejection member when the respective first and second ejection units are attached to the unit reception section.

5. The sheet ejection apparatus as claimed in claim 1 wherein the one of the first sheet ejection unit and the second sheet ejection unit comprises a connection member electrically connected to the processing apparatus main unit at the unit reception section.

6. The sheet ejection apparatus as claimed in claim 1 wherein the one of the first sheet ejection unit and the second sheet ejection unit comprises a positioning member for mechanically positioning with respect to the unit reception section.

7. The sheet ejection apparatus as claimed in claim 1 wherein the one of the first sheet ejection unit and the second sheet ejection unit comprises an attachment section that can be attached with a fixture to the unit reception section.

8. The sheet ejection apparatus as claimed in claim 1 wherein the unit reception section comprises parts that are engageable with engagement parts of each one of the first sheet ejection unit and the second sheet ejection unit.

9. The sheet ejection apparatus as claimed in claim 1 wherein the unit reception section comprises first engaged parts that are engageable with engagement parts of the first sheet ejection unit, and second engaged parts that are engageable with engagement parts of the second sheet ejection unit.

10. The sheet ejection apparatus as claimed in claim 2 wherein the one of the first sheet ejection unit and the second sheet ejection unit comprises an ejection member disposed proximate the sheet stack section, the sheet ejection apparatus further comprising a transmission mechanism for transmitting a driving force from a drive source in the processing apparatus main unit to the ejection member, wherein the transmission mechanism is stopped in a state in which the one of the first sheet ejection unit and the second sheet ejection unit is detached from the processing apparatus main unit.

11. The sheet ejection apparatus as claimed in claim 10 further comprising determination means for determining whether the one of the first sheet ejection unit and the second sheet ejection unit is detached from the processing apparatus main unit, wherein the transmission mechanism is stopped in response to a determination result of the determination means.

12. The sheet ejection apparatus as claimed in claim 11 further comprising:

a cover member that can be opened and closed, being placed on the processing apparatus main unit, for allowing the one of the first sheet ejection unit and the second sheet ejection unit to be attached or detached when the cover is open;

a blocking member for blocking the cover member closing in a state in which the one of the first sheet ejection unit and the second sheet ejection unit is detached; and an interlocking device for disabling operation of the processing apparatus main unit in a state in which the cover member is open, wherein the interlocking device is used as the determination means.

13. The sheet ejection apparatus as claimed in claim 1 wherein the first sheet ejection unit has a sheet ejection capacity set in response to a first sheet transport speed of the processing apparatus main unit, and the second sheet ejection unit has a sheet ejection capacity set in response to a second sheet transport speed of the processing apparatus main unit.

14. The sheet ejection apparatus as claimed in claim 1 wherein the first sheet ejection unit has a first sheet ejection capacity set in response to a first sheet supply amount of the processing apparatus main unit, and the second sheet ejection unit has a second sheet ejection capacity set in response to a second sheet supply amount of the processing apparatus main unit.

15. The sheet ejection apparatus as claimed in claim 1 wherein the first sheet ejection unit has a first sheet ejection capacity set in response to a first sheet processing amount of the processing apparatus main unit, and the second sheet ejection unit has a second sheet ejection capacity set in response to a second sheet processing amount of the processing apparatus main unit.

16. The sheet ejection apparatus as claimed in claim 1 wherein a sensor used for sheet ejection control is disposed before the one of the first sheet ejection unit and the second sheet ejection unit in the sheet transport passage of the processing apparatus main unit.

17. The sheet ejection apparatus as claimed in claim 1 wherein a drive source for driving an ejection member for ejecting a sheet is disposed in the one of the first sheet ejection unit and the second sheet ejection unit.

18. The sheet ejection apparatus as claimed in claim 1 wherein the one of the first sheet ejection unit and the second sheet ejection unit is formed separately from an exterior cover of the sheet ejection apparatus.

19. The sheet ejection apparatus as claimed in claim 1 wherein the one of the first sheet ejection unit and the second sheet ejection unit is formed integrally with an exterior cover of the sheet ejection apparatus.

20. The sheet ejection apparatus as claimed in claim 1 wherein the one of the first sheet ejection unit and the second sheet ejection unit is attached at a side of the processing apparatus main unit.

21. The sheet ejection apparatus as claimed in claim 1 wherein the processing apparatus main unit comprises a fuser for fixing an unfixed image on a sheet and the sheet ejection apparatus is placed downstream from the fuser, wherein the one of the first sheet ejection unit and the second sheet ejection unit is provided with an ejection passage extended in a direction in which a sheet curl occurring at least when the sheet passes through the fuser can be corrected.

22. The sheet ejection apparatus as claimed in claim 1 wherein the one of the first sheet ejection unit and the second sheet ejection unit comprises a face-down ejection passage for ejecting a sheet with an image face down and a face-up ejection passage for ejecting a sheet with an image face up, the face-up and face-down ejection passages being switchable.

23. The sheet ejection apparatus as claimed in claim 1 wherein the one of the first sheet ejection unit and the second sheet ejection unit has switchable ejection passages branching at least in three directions.

24. A sheet ejection apparatus comprising:

a first sheet ejection unit; and a second sheet ejection unit;

wherein one of the first and second sheet ejection units is built in as a part of a processing apparatus main unit for ejecting a sheet processed by a processing section in the processing apparatus main unit to a sheet stack section proximate a top surface of the processing apparatus main unit, and wherein the processing apparatus main unit includes a unit reception section, the one of the first and second sheet ejection units is detachably mounted to the unit reception section.

25. A sheet processing apparatus comprising a sheet ejection apparatus as claimed in claim 24.

26. A sheet ejection unit used in a sheet processing apparatus built in as a part of a processing apparatus main unit for ejecting a sheet processed by a processing section in the processing apparatus main unit through a sheet transport passage to a sheet stack section proximate a top surface of the processing apparatus main unit, the sheet ejection unit comprising:

one of a first and second sheet ejection units;

an interface mounting the one of a first and second sheet ejection units on a unit reception section disposed on the processing apparatus main unit side, wherein the one of a first and second sheet ejection units is detachably mounted to the unit reception section.

27. A sheet ejection apparatus comprising:

a sheet ejection unit having an ejection member; and a processing apparatus main unit having a unit reception section to which the sheet ejection unit is attachable, wherein the sheet ejection unit is built in as a part of the processing apparatus main unit for ejecting a sheet processed by a processing section in the processing apparatus main unit through a sheet transport passage to a sheet stack section proximate a top surface of the processing apparatus main unit by the ejection member that is not provided in the processing apparatus main unit before attaching the sheet ejection unit to the processing apparatus main unit.

* * * * *